US010280697B2

(12) United States Patent
Wright et al.

(10) Patent No.: US 10,280,697 B2
(45) Date of Patent: May 7, 2019

(54) DRILL ROD ALIGNMENT DEVICE AND SYSTEMS AND METHODS OF USING SAME

(71) Applicant: BLY IP INC., Salt Lake City, UT (US)

(72) Inventors: Christopher Allen Wright, North Bay (CA); David Robert Ritter, North Bay (CA); Anthony Charles William Markham, Trout Creek (CA)

(73) Assignee: BLY IP INC., Salt Lake City, UT (US)

( * ) Notice: Subject to any disclaimer, the term of this patent is extended or adjusted under 35 U.S.C. 154(b) by 432 days.

(21) Appl. No.: 15/142,655

(22) Filed: Apr. 29, 2016

(65) Prior Publication Data

US 2016/0356106 A1 Dec. 8, 2016

Related U.S. Application Data

(60) Provisional application No. 62/207,438, filed on Aug. 20, 2015, provisional application No. 62/155,545, filed on May 1, 2015.

(51) Int. Cl.
*E21B 15/00* (2006.01)
*E21B 19/24* (2006.01)

(52) U.S. Cl.
CPC ..... *E21B 19/24* (2013.01); *E21B 15/00* (2013.01)

(58) Field of Classification Search
CPC ..... E21B 19/24
See application file for complete search history.

(56) References Cited

U.S. PATENT DOCUMENTS 2,450,934 A * 10/1948 Calhoun ..... E21B 19/164 166/77.53
2,692,059 A * 10/1954 Bolling, Jr. ..... E21B 19/14 175/85
2,828,024 A * 3/1958 True ..... E21B 19/14 414/22.51
2,829,783 A * 4/1958 Blagg ..... E21B 19/14 294/104

(Continued)

FOREIGN PATENT DOCUMENTS

AR P080103787 8/2008
AU 2008296490 8/2008

(Continued)

OTHER PUBLICATIONS

PCT/US2016/030128, Apr. 29, 2016, Wright et al. (Longyear TM, INC.).

(Continued)

*Primary Examiner* — Blake E Michener
(74) *Attorney, Agent, or Firm* — Ballard Spahr LLP

(57) ABSTRACT

Drill rod alignment devices, systems, and methods for aligning a drill rod with a drill string in a hand-free manner. A drill rod alignment device can have an arm assembly, rod engagement assembly, and a receiving channel secured to the rod engagement assembly. The arm assembly is moveable from a parked position to a deployed position, and the rod engagement assembly is moveable from an open position to a closed position. With the arm assembly in the deployed position, the drill rod alignment device contacts a drill rod and receives a portion of the drill rod within the receiving channel. The arm assembly is moveable to a closed position in which the drill rod is secured within the receiving channel.

31 Claims, 17 Drawing Sheets

(56) References Cited

U.S. PATENT DOCUMENTS

| | | | | | |
|---|---|---|---|---|---|
| 3,533,516 | A * | 10/1970 | Guier | E21B 19/14 | 294/65.5 |
| 3,803,953 | A * | 4/1974 | Geczy | E21B 19/16 | 166/77.51 |
| 3,840,128 | A * | 10/1974 | Swoboda, Jr. | B25J 9/045 | 182/2.11 |
| 4,274,777 | A * | 6/1981 | Scaggs | E21B 19/20 | 294/106 |
| 4,402,557 | A * | 9/1983 | Paasonen | E21B 19/24 | 384/24 |
| 4,440,536 | A * | 4/1984 | Scaggs | E21B 19/20 | 175/85 |
| 4,475,607 | A | 10/1984 | Haney | | |
| 4,681,158 | A * | 7/1987 | Pennison | E21B 19/00 | 166/77.51 |
| 4,921,386 | A * | 5/1990 | McArthur | E21B 19/14 | 414/22.51 |
| 5,062,756 | A * | 11/1991 | McArthur | E21B 19/14 | 294/206 |
| 5,423,390 | A | 6/1995 | Donnally et al. | | |
| 5,458,454 | A | 10/1995 | Sorokan | | |
| 5,595,248 | A * | 1/1997 | Denny | E21B 19/10 | 166/241.6 |
| 5,609,457 | A * | 3/1997 | Burns | E21B 19/24 | 175/85 |
| 5,941,324 | A | 8/1999 | Bennett | | |
| 6,634,443 | B1 | 10/2003 | Paech et al. | | |
| 6,874,834 | B2 * | 4/2005 | McIntosh | B25B 5/087 | 294/104 |
| 7,971,917 | B2 * | 7/2011 | Ge | E21B 19/168 | 166/85.1 |
| 7,997,167 | B2 | 8/2011 | Kruse et al. | | |
| 8,235,104 | B1 | 8/2012 | Sigmar et al. | | |
| 9,428,971 | B2 * | 8/2016 | Pyorny | E21B 7/025 | |
| 9,926,752 | B2 * | 3/2018 | Adams | E21B 19/14 | |
| 2004/0045703 | A1 | 3/2004 | Hooper et al. | | |
| 2006/0011350 | A1 * | 1/2006 | Wiggins | E21B 19/14 | 166/379 |
| 2006/0027047 | A1 | 2/2006 | Buck | | |
| 2008/0202812 | A1 | 8/2008 | Childers et al. | | |
| 2009/0126536 | A1 | 5/2009 | Begnaud et al. | | |
| 2009/0211404 | A1 | 8/2009 | Pedersen et al. | | |
| 2009/0238663 | A1 | 9/2009 | Littlely | | |
| 2011/0103922 | A1 * | 5/2011 | Belik | E21B 19/155 | 414/22.58 |
| 2011/0108265 | A1 * | 5/2011 | Ge | E21B 19/24 | 166/85.1 |
| 2012/0297933 | A1 * | 11/2012 | Lavalley | E02F 3/965 | 81/57.34 |
| 2013/0037324 | A1 | 2/2013 | Milivojevic et al. | | |
| 2014/0209382 | A1 | 7/2014 | Smith et al. | | |
| 2015/0211310 | A1 * | 7/2015 | Evermark | E21B 19/16 | 166/250.01 |
| 2016/0097245 | A1 * | 4/2016 | Jelgert | E21B 7/02 | 166/377 |
| 2016/0115751 | A1 * | 4/2016 | Jelgert | E21B 7/02 | 166/380 |
| 2016/0160586 | A1 * | 6/2016 | Keogh | E21B 19/14 | 414/22.65 |
| 2017/0268302 | A1 * | 9/2017 | Orr | E21B 15/00 | |
| 2017/0328147 | A1 * | 11/2017 | Roy | E21B 19/24 | |

FOREIGN PATENT DOCUMENTS

| | | | |
|---|---|---|---|
| AU | 2008296490 | A1 | 3/2009 |
| AU | 2014373967 | | 12/2014 |
| BR | 1120160152140 | | 12/2014 |
| CA | 2696269 | | 8/2008 |
| CA | 2696269 | A1 | 3/2009 |
| CL | 50.882 | | 8/2008 |
| CL | 2543-2008 | | 8/2008 |
| CL | 2016-01669 | | 12/2014 |
| CN | 200880104593.9 | | 8/2008 |
| CN | 101790619 | A | 7/2010 |
| CN | 2014800718231 | | 12/2014 |
| DE | 3711210 | A1 | 10/1987 |
| EP | 08798826.7 | | 8/2008 |
| EP | 2183460 | A1 | 5/2010 |
| EP | 14876854.2 | | 12/2014 |
| EP | 3090121 | A1 | 11/2016 |
| PE | 1469-2008 | | 8/2008 |
| PE | 964-2016 | | 12/2014 |
| WO | PCT/US2008/074499 | | 8/2008 |
| WO | WO-2009032705 | A1 | 3/2009 |
| WO | PCT/US2014/072580 | | 12/2014 |
| WO | WO-2015103150 | A1 | 7/2015 |
| WO | PCT/US2016/030128 | | 4/2016 |
| ZA | 2010/00778 | | 8/2008 |
| ZA | 2016/05277 | | 12/2014 |

OTHER PUBLICATIONS

International Search Report dated Apr. 3, 2015 by the International Searching Authority for Application No. PCT/US2014/072580 on Dec. 29, 2014 and published as WO 2015/103150 on Jul. 9, 2015 (Applicant—Longyear TM, Inc.; Inventor—Wright et al) (4 pages).

Written Opinion dated Apr. 3, 2015 by the International Searching Authority for Application No. PCT/US2014/072580 on Dec. 29, 2014 and published as WO 2015/103150 on Jul. 9, 2015 (Applicant—Longyear TM, Inc.; Inventor—Wright et al) (14 pages).

International Preliminary Report on Patentability dated Jul. 5, 2016 by the International Searching Authority for Application No. PCT/US2014/072580 on Dec. 29, 2014 and published as WO 2015/103150 on Jul. 9, 2015 (Applicant—Longyear TM, Inc.; Inventor—Wright et al) (15 pages).

Non Final Rejection dated Sep. 30, 2016 by the U.S. Patent and Trademark Office for U.S. Appl. No. 14/584,877 on Dec. 29, 2014 and published as US-2015-0184473-A1 on Jul. 2, 2015 (Applicant—Longyear TM, Inc.; Inventor—Wright et al) (5 pages).

Response to Non Final Rejection dated Oct. 20, 2016 by the U.S. Patent and Trademark Office for U.S. Appl. No. 14/584,877 on Dec. 29, 2014 and published as US-2015-0184473-A1 on Jul. 2, 2015 (Applicant—Longyear TM, Inc.; Inventor—Wright et al) (5 pages).

Notice of Allowance dated Oct. 31, 2016 by the U.S. Patent and Trademark Office for U.S. Appl. No. 14/584,877 on Dec. 29, 2014 and published as US-2015-0184473-A1 on Jul. 2, 2015 (Applicant—Longyear TM, Inc.; Inventor—Wright et al) (6 pages).

International Preliminary Report on Patentability dated Mar. 2, 2010 from International Patent Application No. PCT/US2008/074499 filed Aug. 27, 2008 (Inventor—Christof Kruse et al) (4 pages).

Written Opinion dated Jan. 21, 2009 from International Patent Application No. PCT/US2008/074499 filed Aug. 27, 2008 (Inventor—Christof Kruse et al) (4 pages).

Requirement for Restriction/ Election dated Jan. 13, 2010 by the U.S. Patent and Trademark Office for U.S. Appl. No. 12/197,817 filed Aug. 25, 2008 and published as US-2009-0056931-A1 on Mar. 5, 2009 (Inventor—Christof Kruse et al) (6 pages).

Non Final Rejection dated May 20, 2010 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (9 pages).

Requirement for Restriction/ Election dated Oct. 13, 2010 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (5 pages).

Final Rejection dated Jan. 21, 2011 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (7 pages).

Notice of Allowance dated Feb. 3, 2011 by the U.S. Patent and Trademark Office for Application No. 12/197,817, which was filed on Aug. 25, 2008, and published as US-2009-0056931-A1 on Mar. 5, 2009 (Inventor—Christof Kruse et al) (12 pages).

Notice of Allowance dated Apr. 21, 2011 by the U.S. Patent and Trademark Office for U.S. Appl. No. 12/197,817, which was filed on

(56) References Cited

OTHER PUBLICATIONS

Aug. 25, 2008, and published as US-2009-0056931-A1 on Mar. 5, 2009 (Inventor—Christof Kruse et al) (6 pages).
Notice of Allowance dated May 3, 2011 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (2 pages).
Issue Notification dated Jul. 27, 2011 by the U.S. Patent and Trademark Office for U.S. Appl. No. 12/197,817, which was filed on Aug. 25, 2008, and published as US-2009-0056931-A1 on Mar. 5, 2009 (Inventor—Christof Kruse et al) (1 page).
Notice of Allowance dated May 14, 2012 by the Canadian Intellectual Property Office for Canadian Application No. 2696269, which was filed on Aug. 27, 2008 (Inventor—Christof Kruse et al) (1 Page).
First Office Action dated May 3, 2012 by the State Intellectual Property Office of the People's Republic for Chinese Application No. 200880104693.9, which was filed on Aug. 27, 2008 and published as CN101790619A on Jul. 28, 2010 (Inventor—Christof Kruse, et al) (Original 3 Pages / Translated 5 Pages).
Second Office Action dated Jan. 30, 2013 by the State Intellectual Property Office of the People's Republic for Chinese Application No. 200880104693.9, which was filed on Aug. 27, 2008 and published as CN101790619A on Jul. 28, 2010 (Inventor—Christof Kruse, et al) (Original 3 Pages / Translated 5 Pages).
Third Office Action dated Jul. 19, 2013 by the State Intellectual Property Office of the People's Republic for Chinese Application No. 200880104693.9, which was filed on Aug. 27, 2008 and published as CN101790619A on Jul. 28, 2010 (Inventor—Christof Kruse, et al) (Original 3 Pages / Translated 4 Pages).
Extended European Search Report dated Dec. 18, 2015 by the European Patent Office for Application No. 08798826.7, which was filed on Aug. 27, 2010 and published as 2183460 on May 12, 2010 (Inventor—Christof Kruse, et al) (7 Pages).
International Search Report and Written Opinion dated Aug. 12, 2016 for Application No. PCT/US2016/030128, which was filed on Apr. 29, 2016 (Inventor—Wright et al; Applicant—Longyear TM, Inc.) (6 Pages).
U.S. Appl. No. 60/968,970, filed Aug. 30, 2007, Kruse et al. (Longyear TM, Inc.).
U.S. Appl. No. 12/197,817 (U.S. Pat. No. 7,997,167), filed Aug. 25, 2008 (Aug. 16, 2011), Kruse et al. (Longyear TM, Inc.).
U.S. Appl. No. 61/921,9830, filed Dec. 30, 2013, Christopher Wright (Longyear TM, Inc.).
U.S. Appl. No. 62/052,712, filed Sep. 19, 2014, Markham et al. (Longyear TM, Inc.).
U.S. Appl. No. 14/584,877 (2015-0184473-A1), filed Dec. 29, 2014, Markham et al. (Longyear TM, Inc.).
U.S. Appl. No. 62/155,545, filed May 1, 2015, Markham et al. (Longyear TM, Inc.).
U.S. Appl. No. 62/207,438, filed Aug. 20, 2015, Wright et al. (Longyear TM, Inc.).

* cited by examiner

DRILL ROD ALIGNMENT DEVICE AND SYSTEMS AND METHODS OF USING SAME

CROSS-REFERENCE TO RELATED APPLICATIONS

This application claims priority to and the benefit of the filing date of U.S. Provisional Patent Application No. 62/207,438, filed Aug. 20, 2015, and U.S. Provisional Patent Application No. 62/155,545, filed May 1, 2015. Each of these patent applications is incorporated by reference herein in its entirety.

FIELD

This invention relates to devices, systems, and methods for aligning a drill rod with a drill string to permit engagement between the drill rod and the drill string.

BACKGROUND

When adding drill rods to a drill string using conventional drilling systems, the position of the lower rod joint can vary as the drill rig shifts over the hole where drilling is occurring. To account for such variations in position, drill operators are often required to manually push on the drill rod to ensure that the drill rod is properly aligned with the drill string. This creates significant safety risks for drill operators and also reduces the efficiency of drilling operations.

Thus, there is a need in the pertinent art for devices, systems, and methods that provide a hands-free solution for adding drill rods to drill strings.

SUMMARY

Described herein, in one aspect, is a drill rod alignment device for aligning a drill rod with a drill string supported by a drill mast having a longitudinal axis. The drill rod alignment device can have a feed frame assembly, an arm assembly, and a rod engagement assembly. The feed frame assembly can be configured for operative coupling to the drill mast and can be configured for selective axial movement relative to the longitudinal axis of the drill mast. The arm assembly can have at least one arm linkage that is pivotally coupled to the feed frame assembly to permit pivotal movement of the arm assembly about and between a parked position and a deployed position. The rod engagement assembly can have a carrier arm and a guide arm. A rod-supporting subassembly that defines a receiving channel is secured to the carrier arm. A first end of the carrier arm can be pivotally coupled to the at least one arm linkage of the arm assembly, and the guide arm can be pivotally coupled to a second end of the carrier arm. At least one roller can be coupled to the guide arm and configured for rotation. With the arm assembly in the deployed position, the rod-supporting subassembly can contact a drill rod and effect pivotal movement of the carrier arm relative to the at least one arm linkage of the arm assembly, and the guide arm can be selectively pivoted relative to the carrier arm from an open position to a closed position in which the at least one roller secures the drill rod within the receiving channel. Drilling systems and methods of using the drill rod alignment device are also disclosed.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein:

FIG. 1 is a perspective view of an exemplary drill rod alignment device as disclosed herein.

FIG. 2A is an exploded front perspective view of an exemplary drill rod alignment device as disclosed herein. FIG. 2B is a partially exploded back perspective view of the drill rod alignment device of FIG. 2A. FIG. 2C is a partially exploded close-up perspective view of a clamping subassembly of the drill rod alignment device of FIGS. 2A-2B.

FIG. 5 shows the positions of the ground, the mast foot, the foot clamp, the head spindle, the chuck, and and the barrier of an exemplary drilling system, with the spindle and chuck each being shown at the extents of their strokes (top and bottom).

Figure 6:
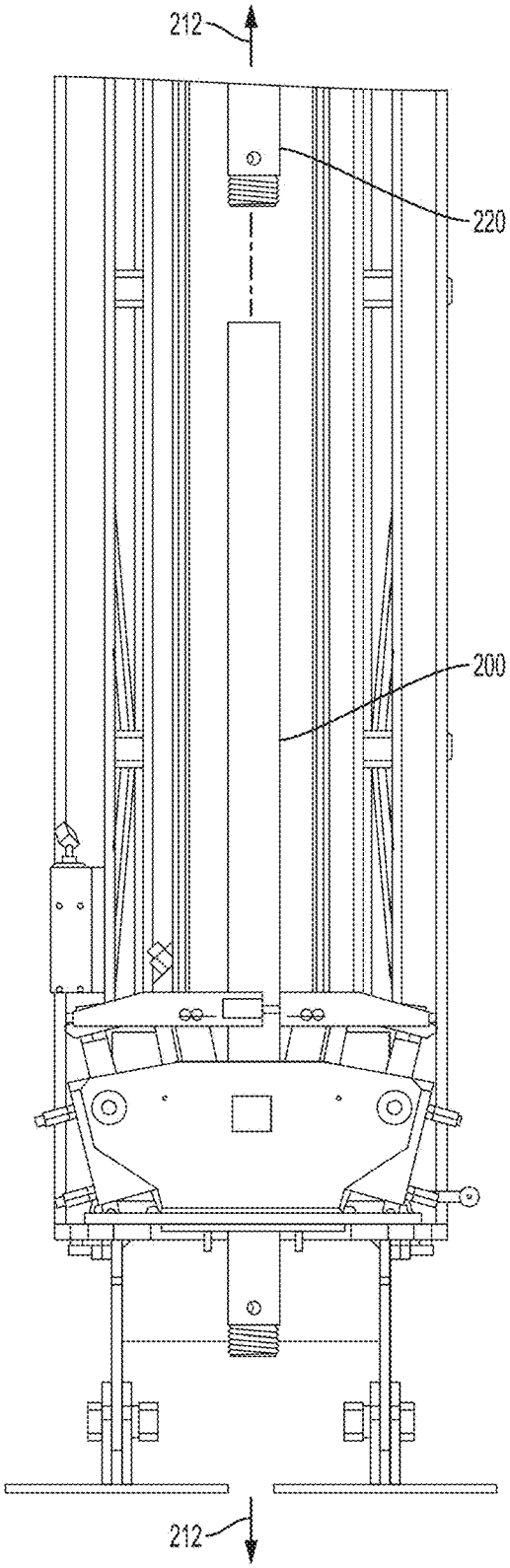

FIG. 6 depicts the joining of a drill rod with a drill string as disclosed herein. As shown, the top of the lower rod has a female thread and the bottom of the upper rod has a male thread. In operation, the disclosed alignment device can align the joint between the female thread of the lower rod and the male thread of the upper rod. It is contemplated that this joint position can vary from just above the foot clamp to approximately 1 m above the foot clamp.

Figure 7:
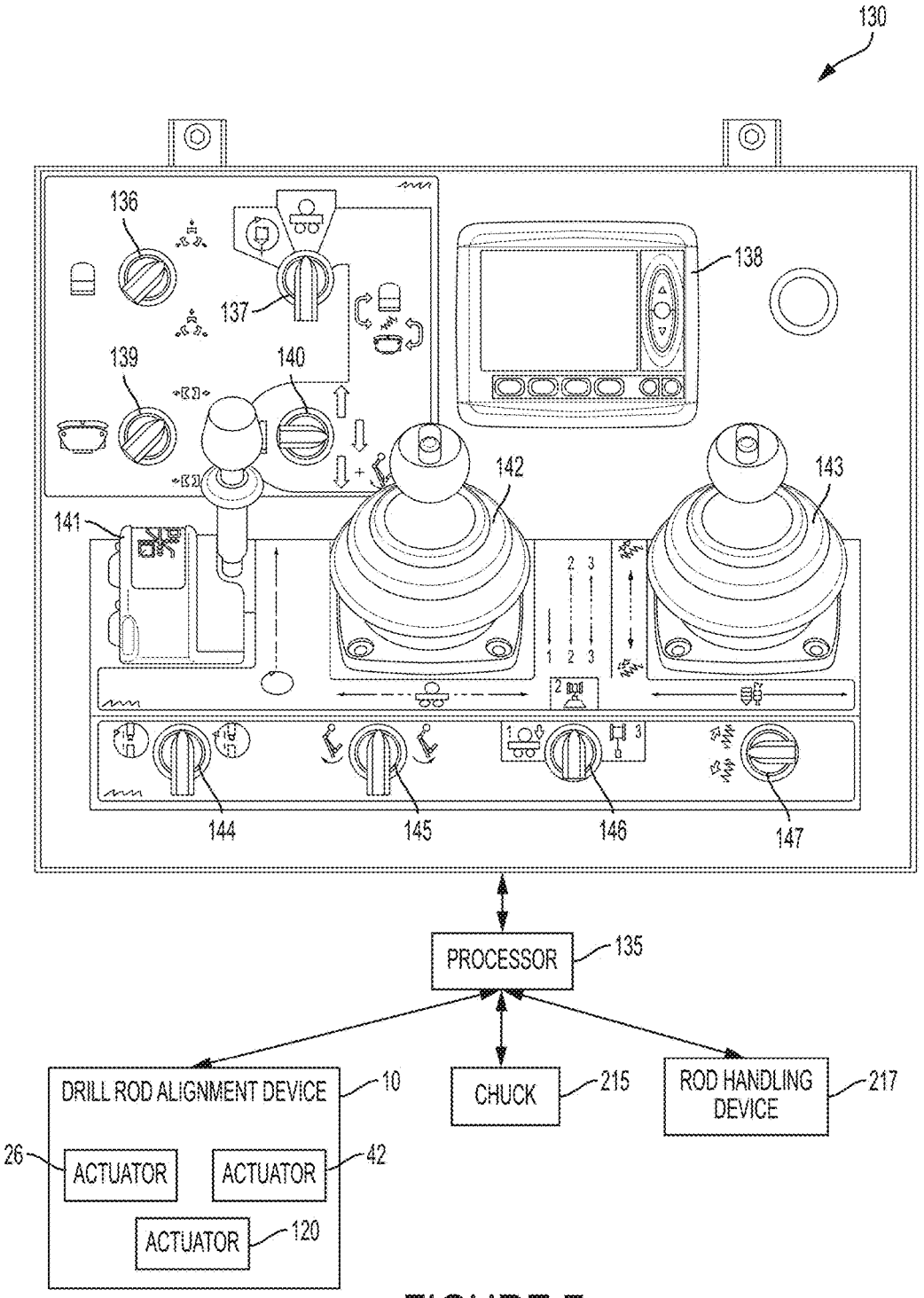

FIG. 7 schematically depicts the interaction between processing components and the actuators of a drill rod alignment device, a chuck, and a rod handling device as disclosed herein. As shown, the processing components can include a Programmable Logic Controller (PLC).

Figure 8A:
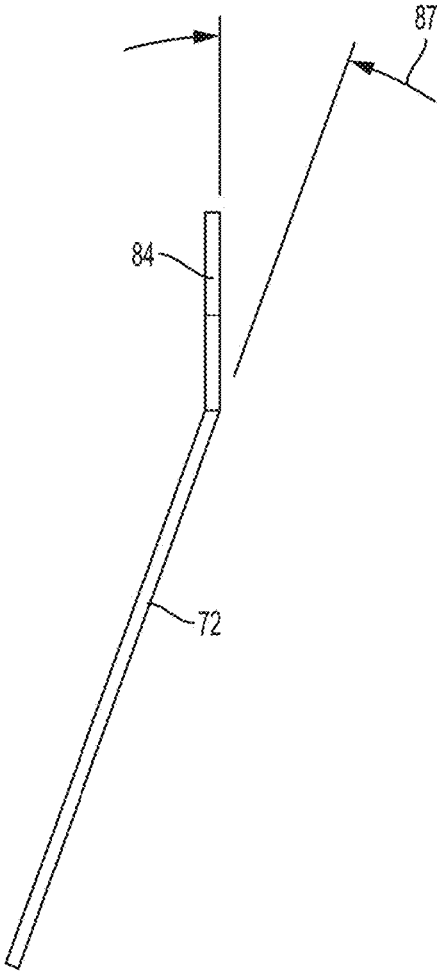
Figure 8B:
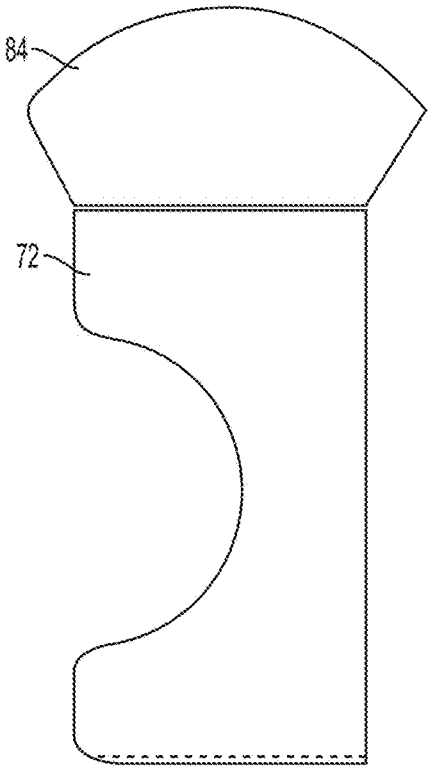

FIGS. 8A and 8B are isolated cross-sectional and front views of a portion of a rod-supporting assembly as disclosed herein.

FIGS. 9A-9E depict the sequential movement of an exemplary drill rod alignment device from a parked (fully retracted), open position to a deployed, closed position as disclosed herein.

Figure 10:
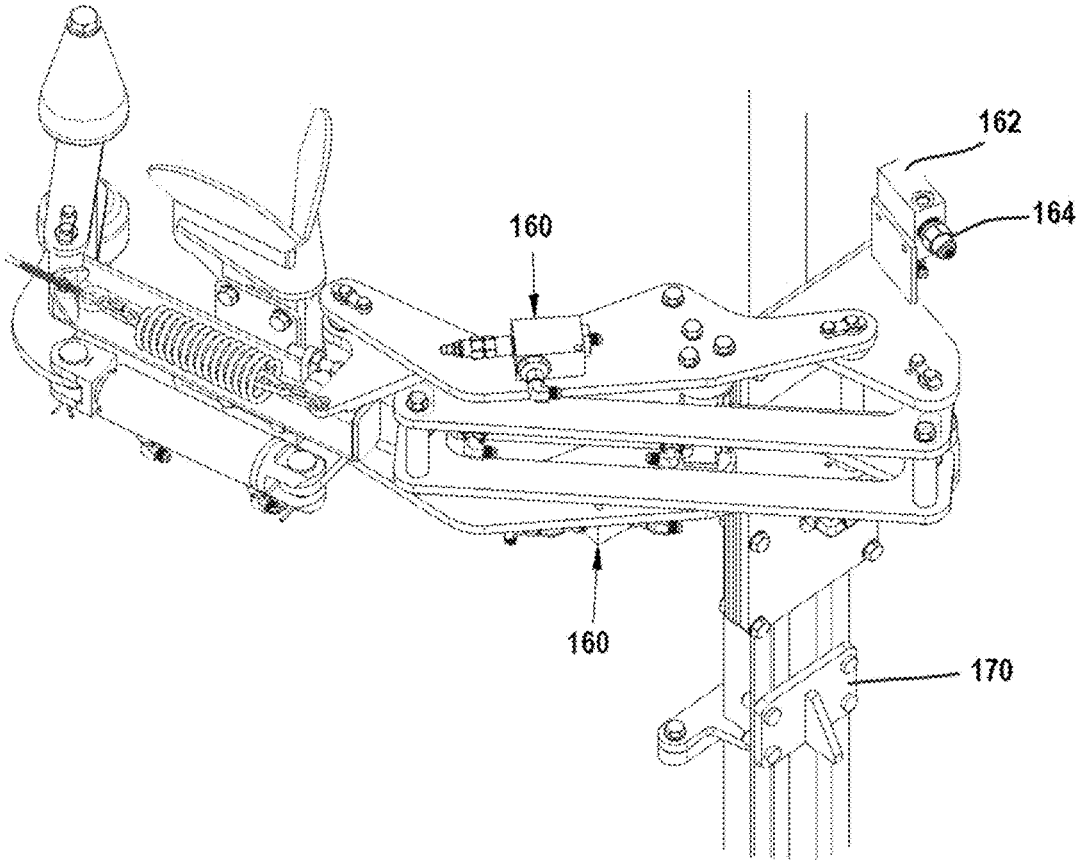

FIG. 10 is a perspective view of an exemplary drill rod alignment device as disclosed herein, showing exemplary hydraulic sequencing components and a lift stop element.

Figure 11A:
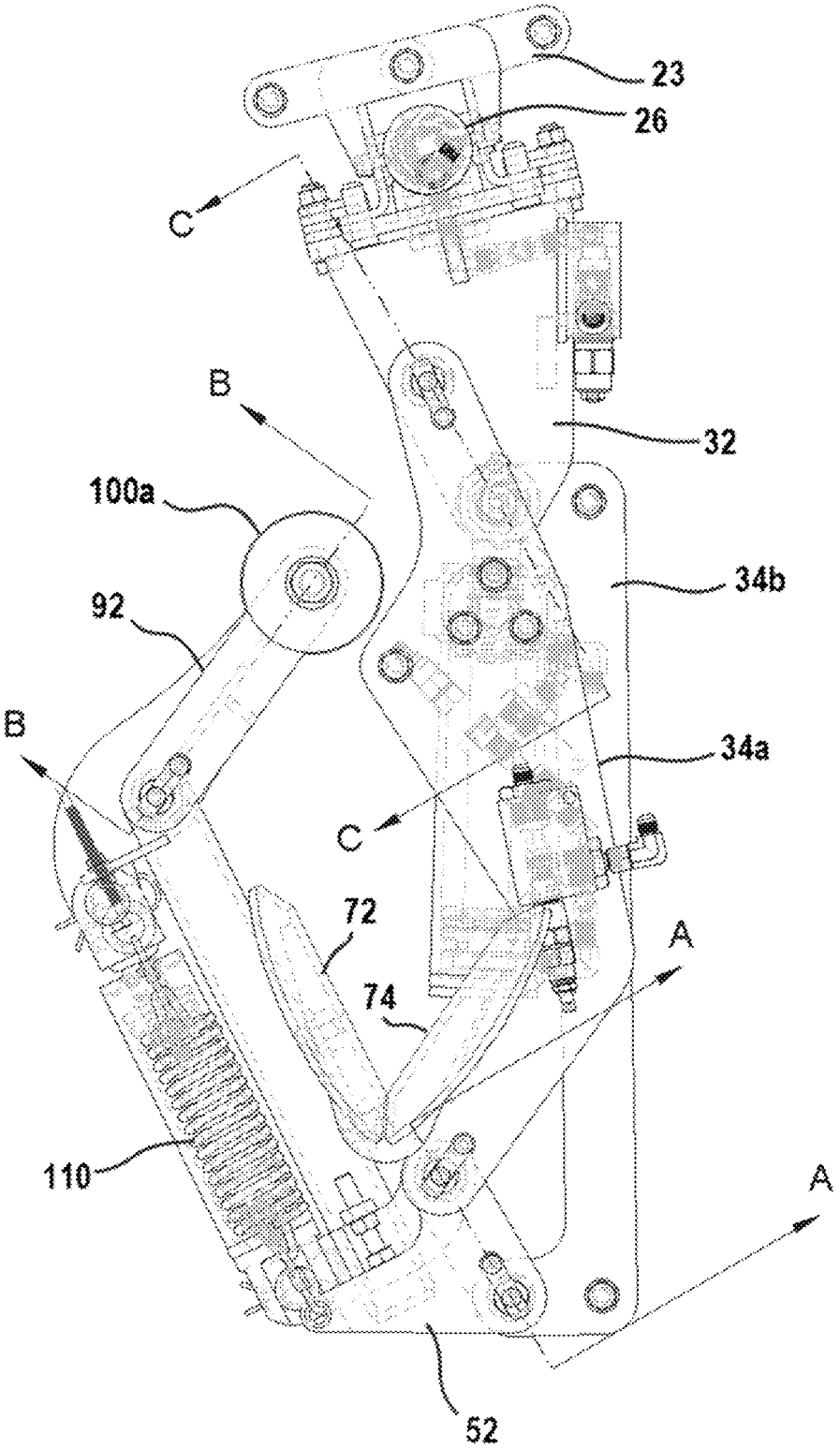
Figure 11B:
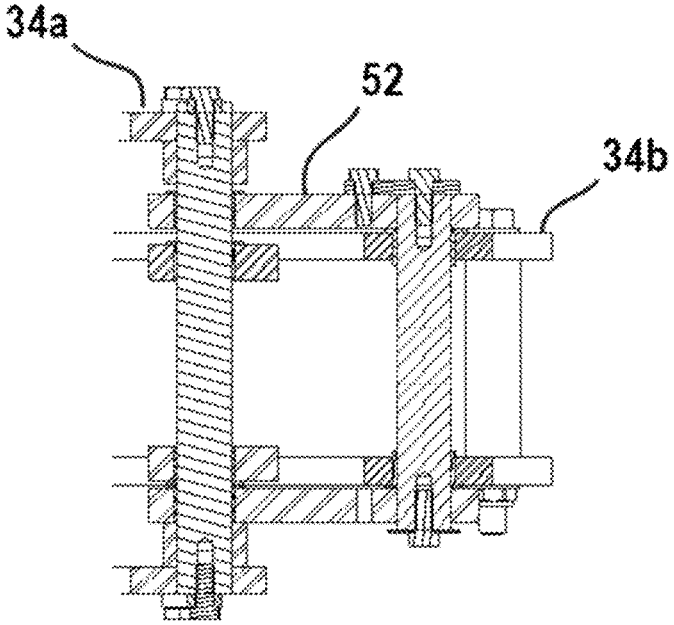
Figure 11C:
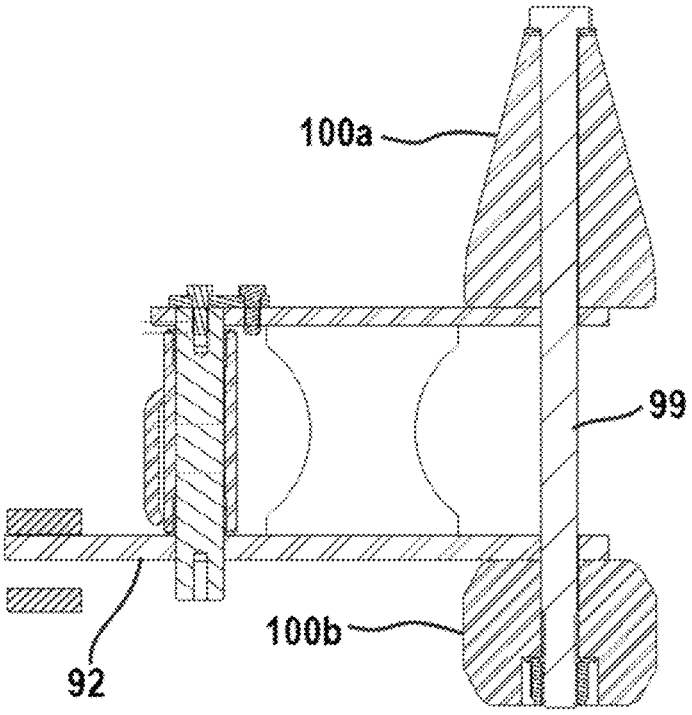
Figure 11D:
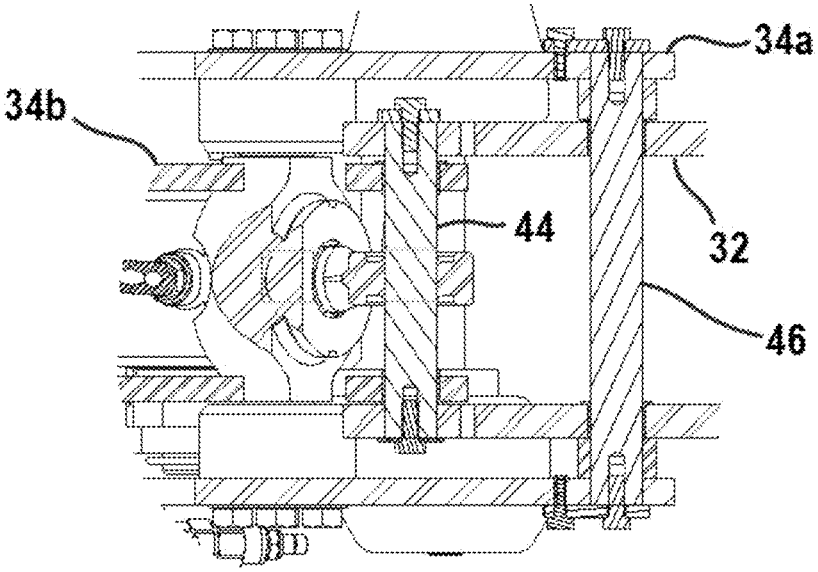

FIG. 11A is a top, partially transparent view of an exemplary drill rod alignment device. FIGS. 11B-11D are cross-sectional views of the drill rod alignment device of FIG. 11A, taken at lines A-A, B-B, and C-C respectively.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "an actuator" can include two or more such actuators unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the term "substantially parallel" refers to an orientation of axes or other elements in which the axes or elements are parallel to one another or oriented at an angle of less than 30 degrees or, more preferably, less than 15 degrees, relative to each other.

Described herein with reference to FIGS. 1-11D is a drill rod alignment device 10 for aligning a drill rod 220 with a drill string 200 supported by a drill mast 210. The drill mast 210 can be provided as a component of a coring drill rig or a percussive drill rig, in either surface or underground applications. However, it is contemplated that the drill rod alignment device 10 can be used in any type of drilling operation. As used herein, the term "drill rod alignment device" is used interchangeably with the terms "rod making alignment device" and "RMAD." The drill mast 210 can have a longitudinal axis 212. In exemplary aspects, the drill rod alignment device 10 comprises a feed frame assembly 20, an arm assembly 30, and a rod engagement assembly 50.

In one aspect, the feed frame assembly 20 can be configured for operative coupling to the drill mast 210. In this aspect, at least a portion of the feed frame assembly 20 can be configured for selective axial movement relative to the longitudinal axis 212 of the drill mast 210.

In another aspect, and with reference to FIGS. 1-4B, the arm assembly 30 can comprise a support element 32 and at least one arm linkage, such as, for example, outer and inner arm linkages 34*a*, 34*b* as further described herein. In this aspect, the support element 32 can be secured to the feed frame assembly 20 such that axial movement of the feed frame assembly effects a corresponding axial movement of the support element. In an additional aspect, the at least one arm linkage can have a proximal end 36 (36*a* for outer arm linkages, 36*b* for inner arm linkages) and a distal end 38 (38*a* for outer arm linkages, 38*b* for inner arm linkages). In this aspect, the proximal end 36 of the at least one arm linkage can be pivotally coupled to the support element 32, and the at least one arm linkage can be configured for selective pivotal movement relative to a first rotational axis 40 that is substantially parallel to the longitudinal axis 212 of the drill mast 210. In operation, pivotal movement of the at least one arm linkage relative to the support element 32 can effect movement of the arm assembly 30 about and between a parked position and a deployed position. For example, as shown in FIGS. 3A-4B, to move the arm assembly 30 from the parked position to the deployed position, it is contemplated that the at least one arm linkage can be rotated relative to the support element until the inner arm linkages are positioned at a desired obtuse angle relative to the axis by which the support element extends from the feed frame assembly (see FIG. 3A). To move the arm assembly 30 from the deployed position to the parked position, it is contemplated that the arm linkages can be rotated relative to the support element 32 until the inner arm linkages extend outwardly from the feed frame assembly in substantial alignment with the support element (relative to the axis by which the support element extends away from the feed frame assembly).

In exemplary aspects, and with reference to FIGS. 1-4B, the rod engagement assembly 50 can comprise a coupling frame 52, a carrier arm 60, a rod-supporting subassembly 70, and a clamping subassembly 90. In one aspect, the coupling frame 52 can have a first end 54 and an opposed second end 56. In this aspect, the first end 54 of the coupling frame 52 can be pivotally coupled to the distal end 38 of the at least one arm linkage. In another aspect, the coupling frame 52 can be configured for selective pivotal movement relative to a second rotational axis 58 that is substantially parallel to the first rotational axis 40. In an additional aspect, the carrier arm 60 can have a first end 62 and an opposed second end 64. In this aspect, the first end 62 of the carrier arm 60 can be pivotally coupled to the first end 54 of the coupling frame 52. Optionally, in some aspects, and as shown in FIGS. 1-4B, the coupling frame 52 can comprise upper and lower plates 53*a*, 53*b* that are spaced apart relative to the longitudinal axis 212 of the mast 210 and retained in their spaced orientation by spacers 55*a*, 55*b*. In a further aspect, the rod-supporting subassembly 70 can be secured (e.g., mounted) to the carrier arm 60. In this aspect, the rod-supporting subassembly 70 can define a receiving channel 76 that is configured to receive the drill rod 220. Optionally, it is contemplated that the receiving channel 76 can be substantially V-shaped. For example, it is contemplated that the receiving channel 76 can be formed by two angled, substantially planar surfaces that come together at a vertex as shown in FIGS. 1-4B. However, it is contemplated that other shapes (e.g., a U-shaped channel) can be used.

Figure 2A:
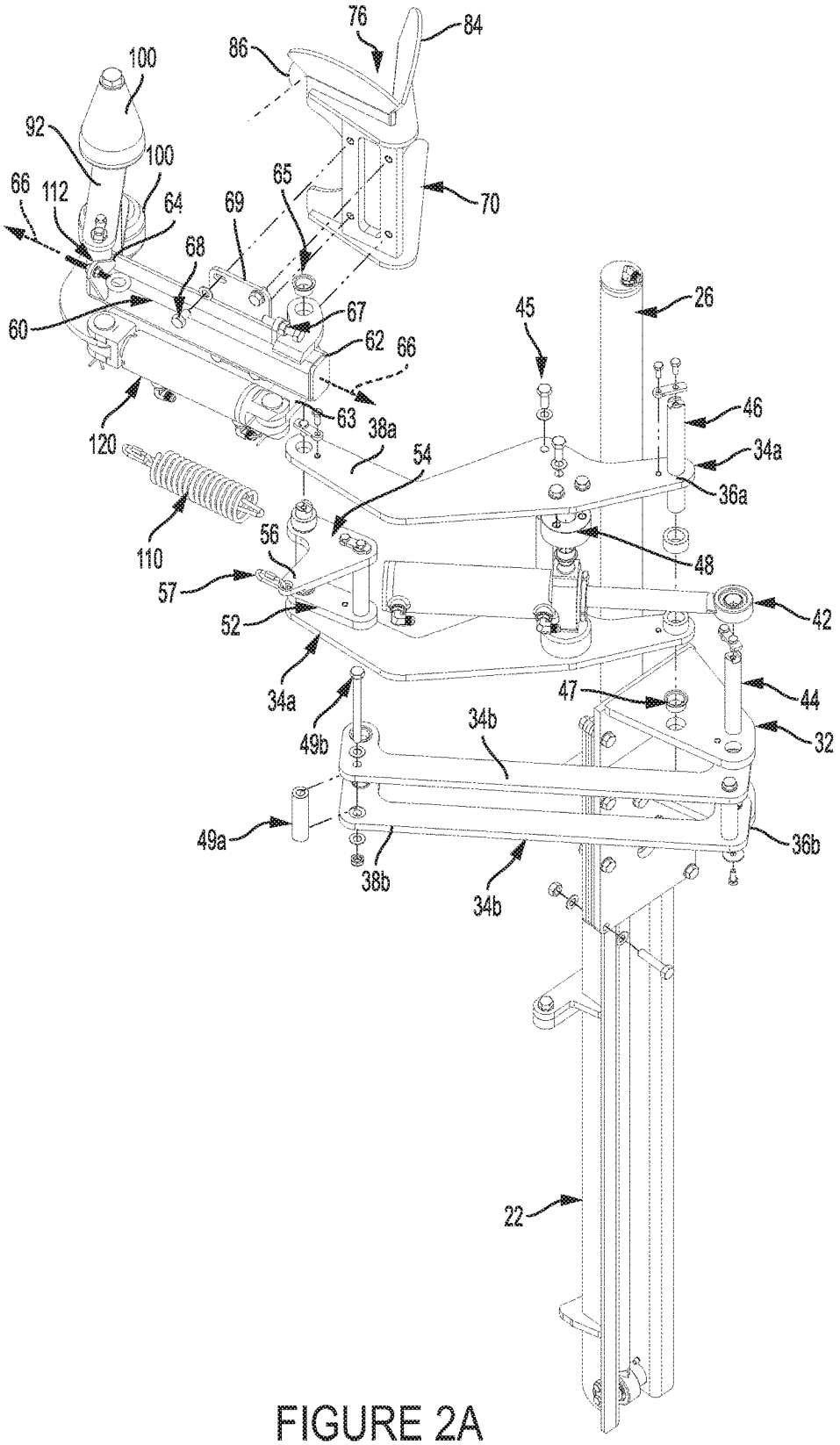

In still another aspect, the clamping subassembly 90 can have a guide arm 92 and at least one roller 100, such as, for example and without limitation, guiding and clamping rollers 100*a*, 100*b* as further described herein. In this aspect, the guide arm 92 can have a first end 94 and an opposed second end 96. It is contemplated that the first end 94 of the guide arm 92 can be pivotally coupled to the second end 64 of the carrier arm 60, and the guide arm 92 can be configured for selective pivotal movement relative to a third rotational axis 98 that is substantially parallel to the first rotational axis 40. Optionally, as shown in FIG. 2C, the guide arm 92 can have spaced top and bottom arm elements, with the top arm element connected to the bottom arm element by a brace 93, the top arm element pivotally coupled to the carrier arm 60, and the bottom arm element pivotally coupled to the actuator 120 as further disclosed herein. In a further aspect, the at least one roller (e.g., the guiding and clamping rollers 100*a*, 100*b*) can be configured for rotational movement relative to a fourth rotational axis 102 that is substantially parallel to the first rotational axis 40. In exemplary aspects, as shown in FIG. 2C, the rollers 100*a*, 100*b* can be pivotally coupled to the guide arm 92 by a pin or bolt 99 that extends through distal end portions of the top and bottom arm elements. In further exemplary aspects, a second pin 97 can extend through the proximal end portions of the top and bottom arm elements. In operation, and as shown in FIGS. 9A-9E, the guide arm 92 can be configured for selective pivotal movement about and between an open position (FIGS. 9A-9D) and a closed position (FIG. 9E). In the closed position, the at least one roller can be configured to secure the drill rod 220 within the receiving channel 76.

In exemplary aspects, and with reference to FIGS. 1-4B, the rod engagement assembly 50 can further comprise a spring 110 that is coupled to and extends between the second end 56 of the coupling frame 52 and the second end 64 of the carrier arm 60. In these aspects, the rod engagement assembly 50 can further comprise an eyebolt 112 that is operatively coupled to the spring 110 and configured to permit selective adjustment of the tension of the spring. Optionally, in exemplary aspects, the rod engagement assembly 50 can comprise a link 57 that extends between and is coupled to the second end 56 of the coupling frame 52 and the spring 110 as shown in FIG. 2A. In exemplary aspects, it is contemplated that the spring 110 can be configured to accommodate up to about 300 pounds of tension.

Figure 1:
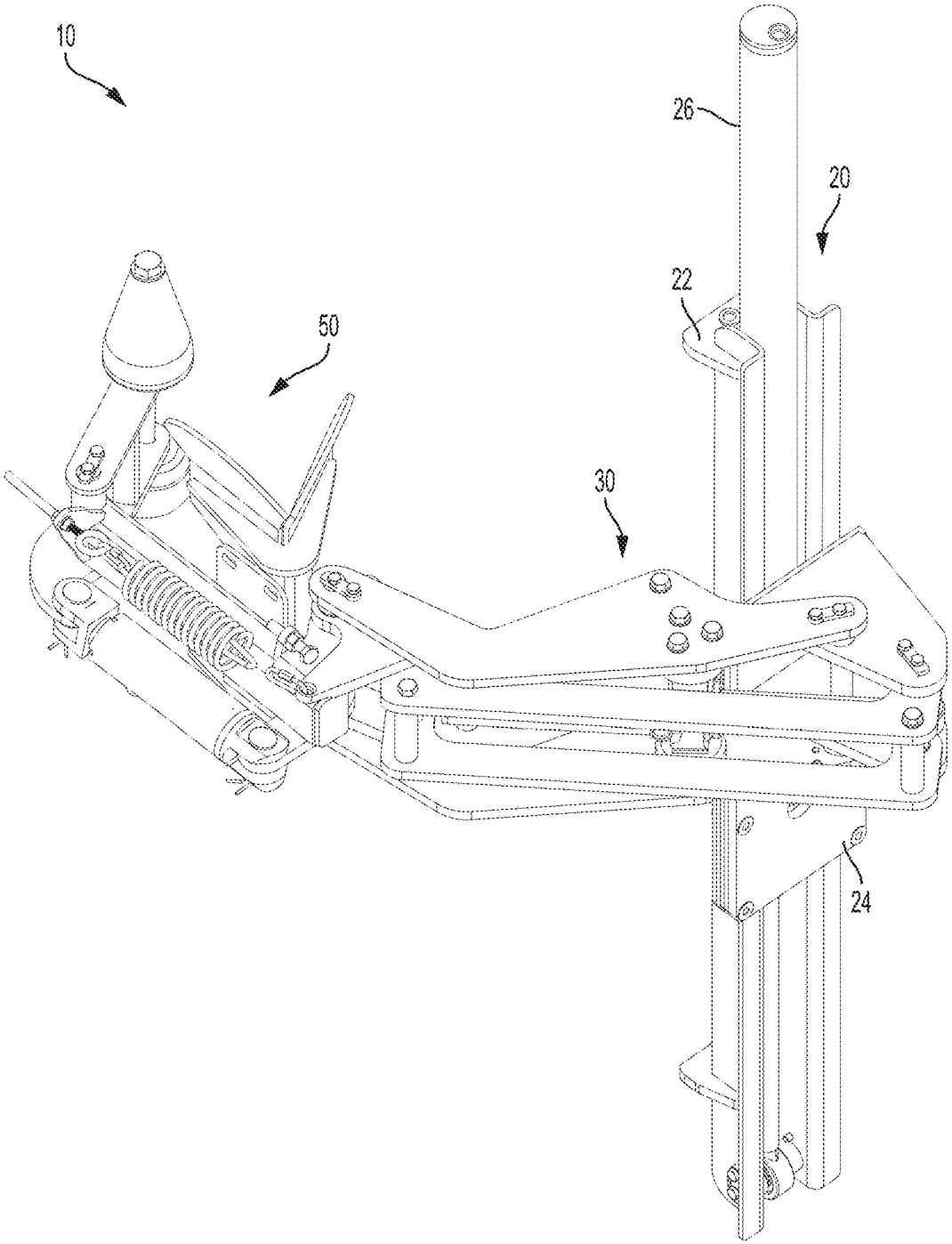
Figure 2B:
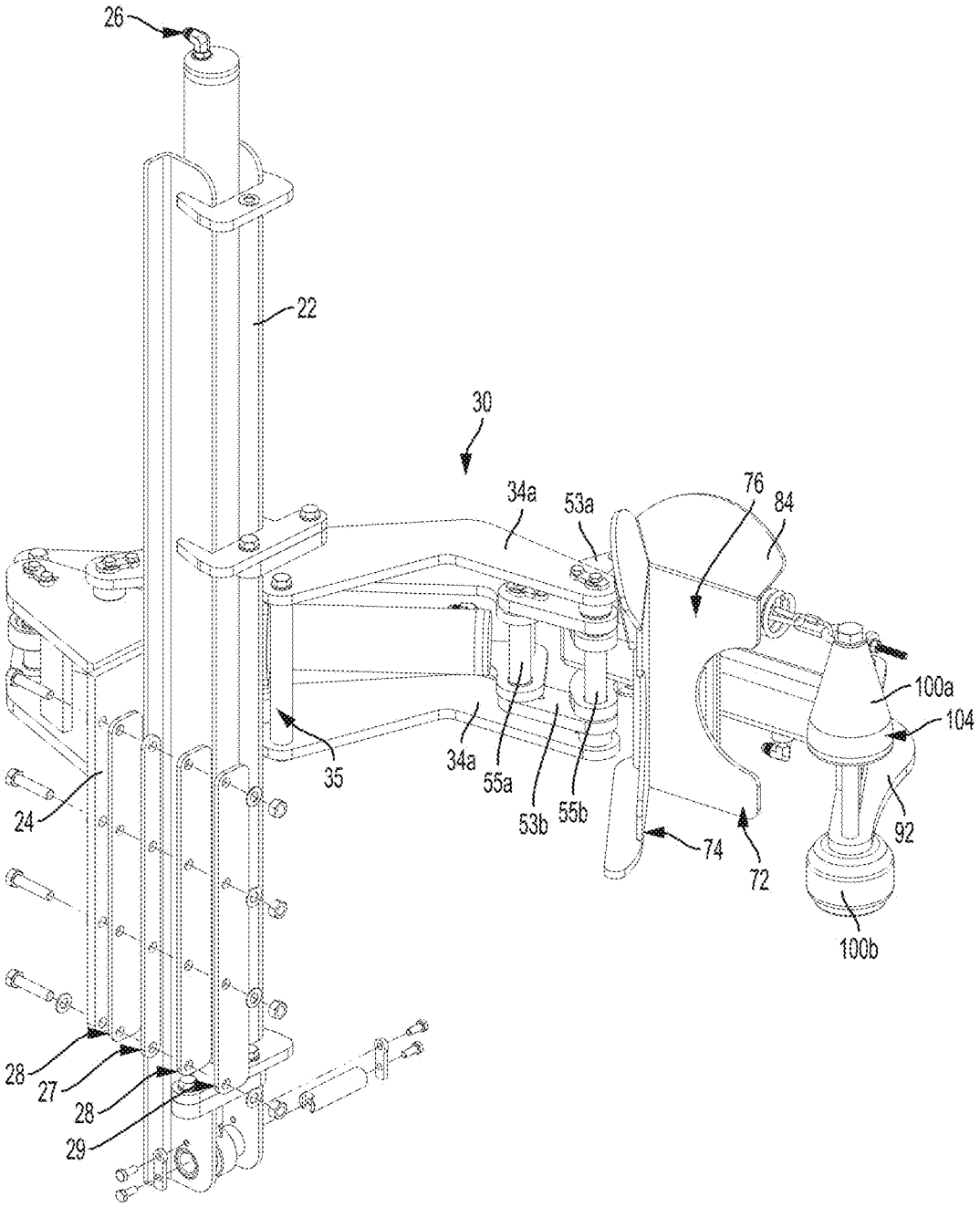
Figure 2C:
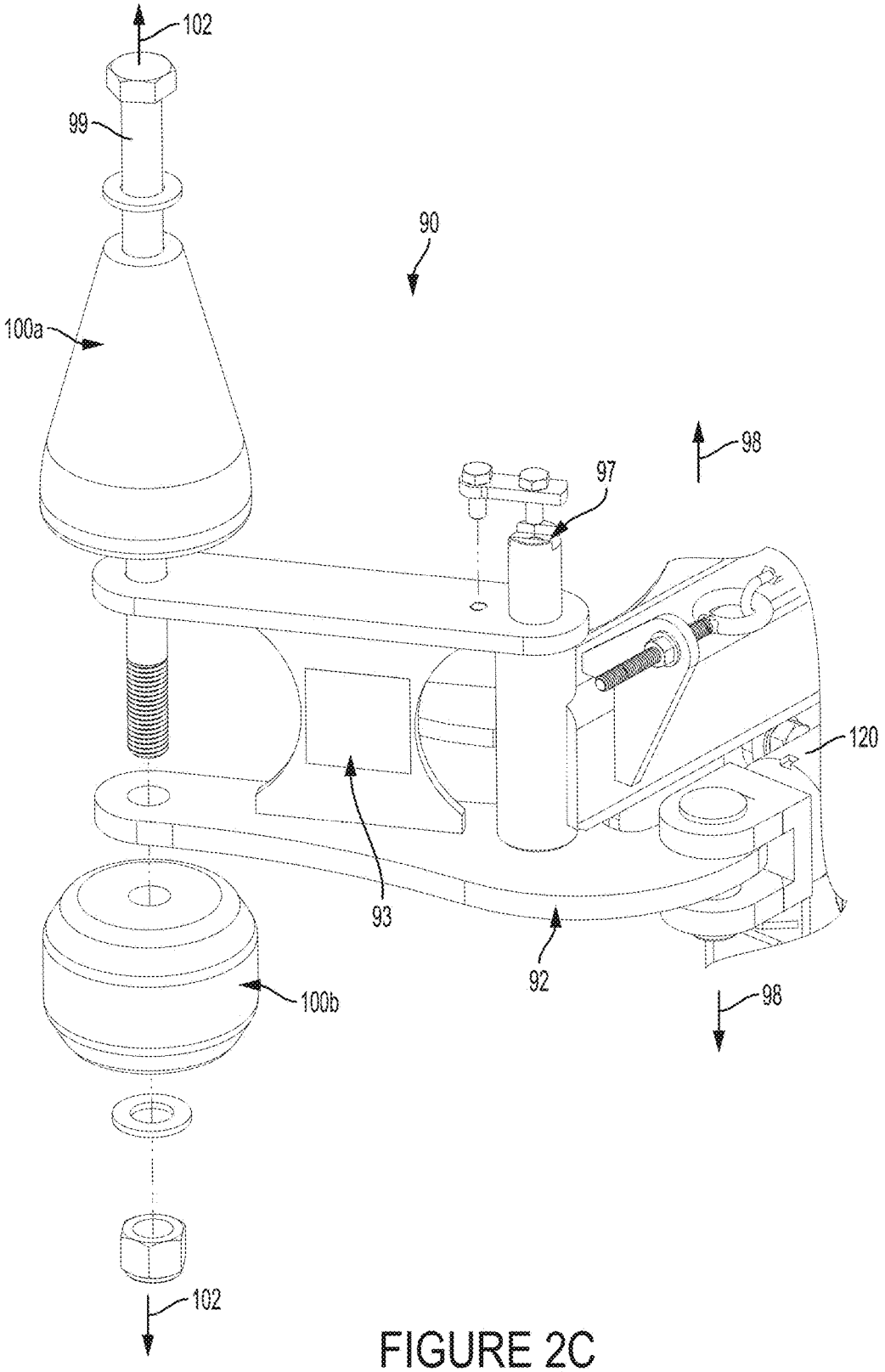
Figure 3B:
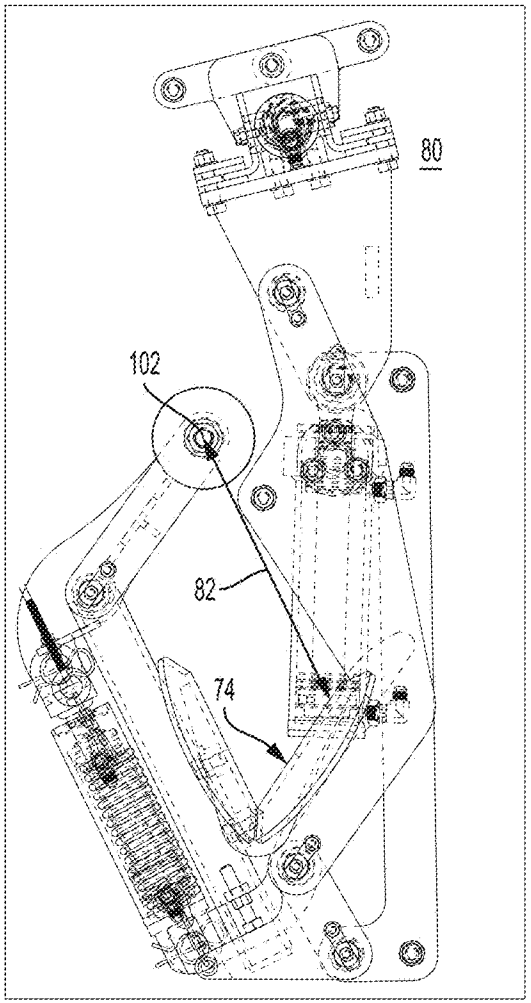
FIG. 3B is a top elevational view of the drill rod alignment device of FIG. 3A, with the drill rod alignment device shown in a parked (fully retracted) position as disclosed herein.
Figure 3A:
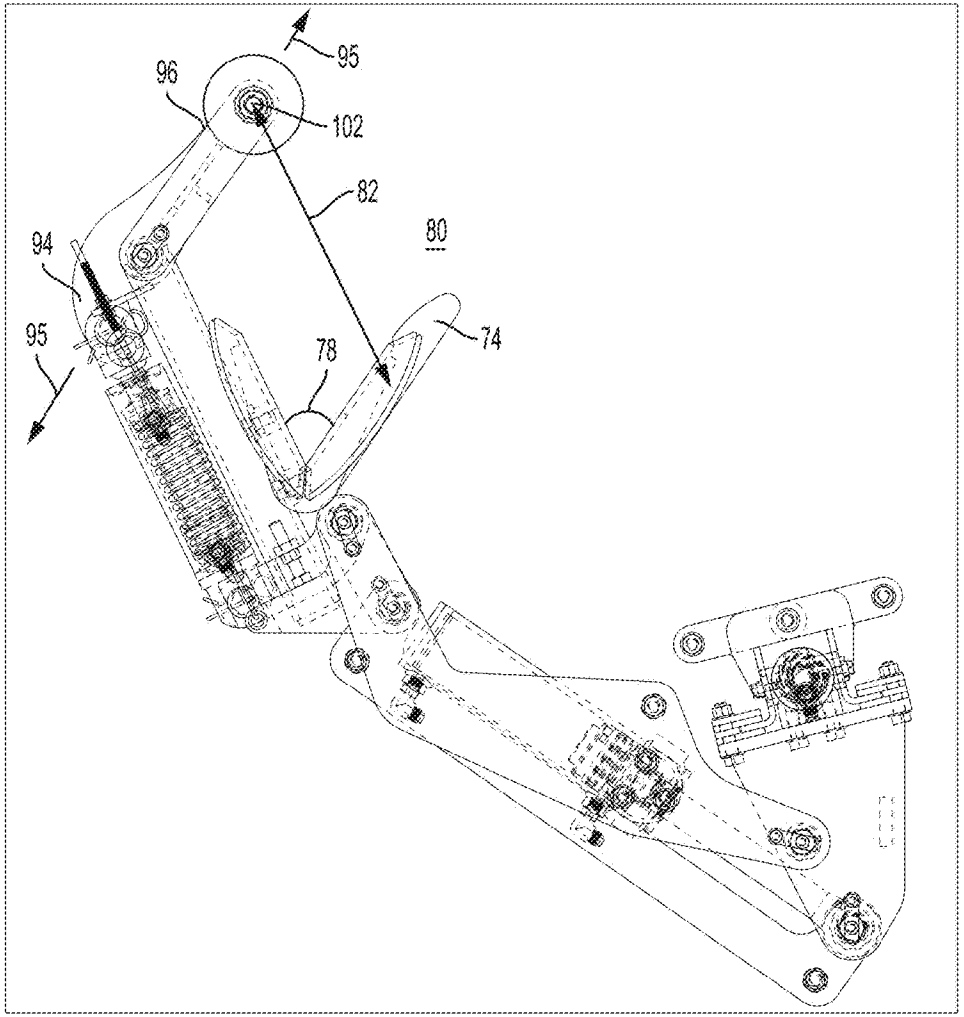
FIG. 3A is a top elevational view of an exemplary drill rod alignment device, with the drill rod alignment device shown in a deployed position as disclosed herein.

In additional exemplary aspects, and with reference to FIGS. 1-2C, the feed frame assembly 20 can comprise a feed frame 22, a carrier plate 24, and an actuator 26. In these aspects, the feed frame 22 can be secured to the drill mast 210, and the carrier plate 24 can be configured for axial movement relative to the feed frame 22. In exemplary aspects, the feed frame can define at least one welding plate that is configured for secure attachment to a portion of the mast 210. The actuator 26 can be operatively coupled to the carrier plate 24 and configured to effect selective axial movement of the carrier plate relative to the longitudinal axis 212 of the drill mast 210. In another aspect, the support element 32 of the arm assembly 30 can be secured to the carrier plate 24 of the feed frame assembly 20. Optionally, it is contemplated that the actuator 26 of the feed frame assembly 20 can comprise a hydraulic cylinder. However, it is contemplated that any conventional linear actuator (e.g., a pneumatic actuator, a mechanical actuator, an electromechanical actuator, and the like) can be used to effect movement of the carrier plate 24 as disclosed herein. In exemplary aspects, the feed frame assembly 20 can further comprise at least two wear pads 28, at least one spacer 27 positioned between the wear pads, and a slide clamp plate that are secured to a back surface of the carrier plate 24 as shown in FIG. 2B.

In further exemplary aspects, and as shown in FIGS. 1-4B, the at least one arm linkage can comprise a pair of outer arm linkages 34*a* and at least one inner arm linkage 34*b*. In these aspects, the outer arm linkages 34*a* can be spaced apart relative to the longitudinal axis 212 of the drill mast 210, and the at least one inner arm linkage 34*b* can be positioned between the outer arm linkages 34*a* relative to the longitudinal axis 212 of the drill mast 210. Optionally, the at least one inner arm linkage 34*b* can comprise a pair of inner arm linkages that are spaced apart relative to the longitudinal axis 212 of the drill mast.

Figure 4B:
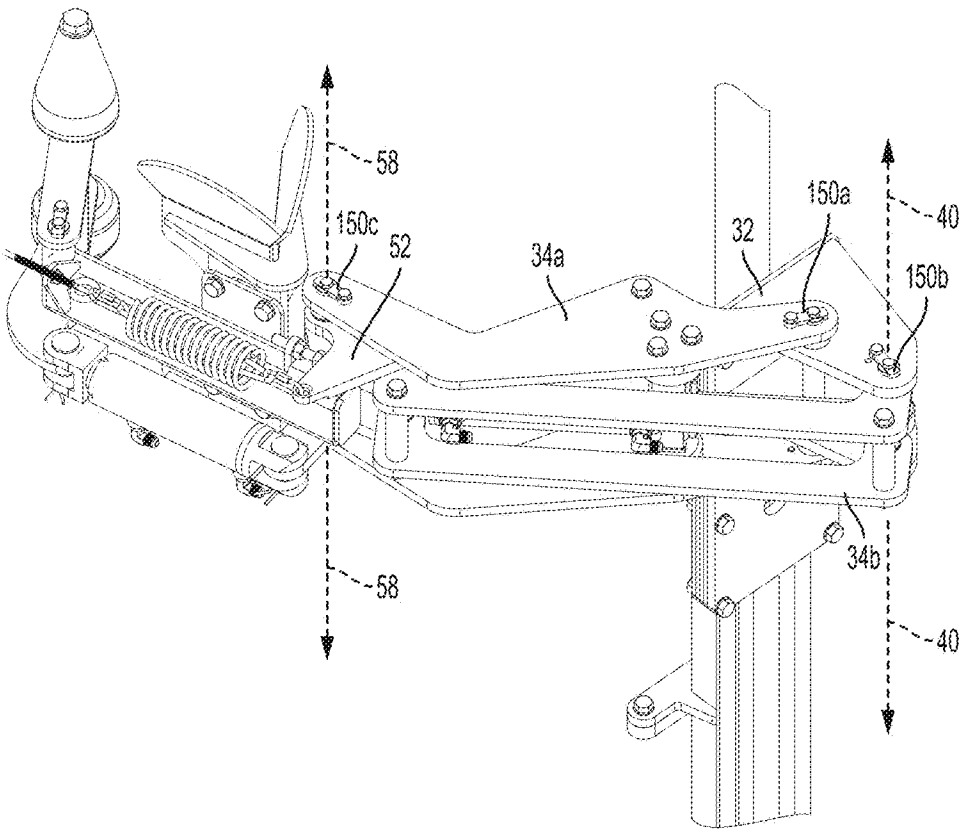
FIG. 4B is a perspective view of the drill rod alignment device of FIG. 4A, with the drill rod alignment device shown in a deployed position as disclosed herein.
Figure 4A:
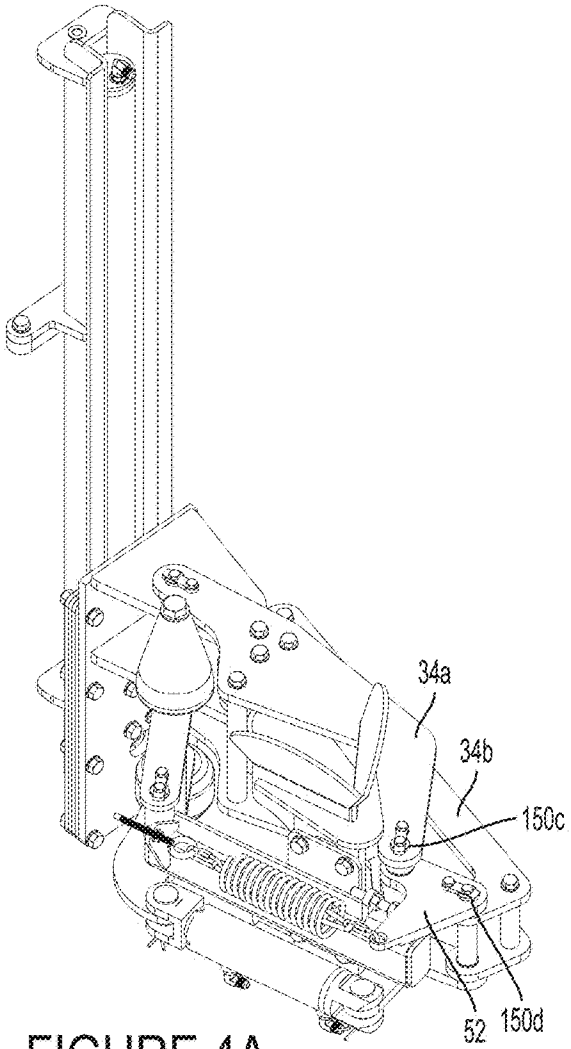
FIG. 4A is a perspective view of an exemplary drill rod alignment device, with the drill rod alignment device shown in a parked (fully retracted) position as disclosed herein.

In further exemplary aspects, and as shown in FIG. 2A, the arm assembly 30 can comprise an actuator 42 that is operatively coupled to the at least one inner arm linkage 34*b* and configured to effect pivotal movement of the at least one inner arm linkage relative to the support element 32. Optionally, it is contemplated that the actuator 42 can comprise a hydraulic cylinder. However, it is contemplated that any conventional actuator (e.g., a pneumatic actuator, a mechanical actuator, an electromechanical actuator, and the like) can be used to effect pivotal movement of the inner arm linkage relative to the support element 32 as disclosed herein. Optionally, in another aspect, the actuator 42 of the arm assembly 40 can be secured to the pair of outer arm linkages. In one aspect, as shown in FIGS. 4A-4B, the pair of outer arm linkages 34*a* can be pivotally coupled to the support element 32 at a first pivot point 150*a*. In this aspect, it is also contemplated that the at least one inner arm linkage 34*b* can be pivotally coupled to the support element 32 at a second pivot point 150*b*, which can be positioned radially outwardly of the first pivot point 150*a* relative to the longitudinal axis 212 of the drill mast 210.

In further exemplary aspects, and with references to FIGS. 2A-4B, the first end 54 of the coupling frame 52 can be pivotally coupled to the pair of outer arm linkages 34*a* at a third pivot point 150*c* and the first end 54 of the coupling frame 52 can be pivotally coupled to the at least one inner arm linkage 34*b* at a fourth pivot point 150*d*. In these aspects, and as shown in FIG. 4A, the fourth pivot point 150*d* can be spaced from the third pivot point 150*c*. Optionally, in exemplary aspects, the coupling frame 52 can be substantially L-shaped. In these aspects, when the coupling frame 52 comprises top and bottom plates 53*a*, 53*b* as disclosed herein, it is contemplated that the top plate 53*a* can be substantially L-shaped, while the bottom plate 53*b* can have a different shape, such as, for example and without limitation, a rectangular, oval, or elliptical shape. In another aspect, and as shown in FIGS. 2A-2B, the carrier arm 60 of the rod-supporting subassembly 50 can have a longitudinal axis 66, and the longitudinal axis of the carrier arm can be substantially parallel to the spring 110.

In further exemplary aspects, and with reference to FIGS. 2A-2C, the at least one roller 100 of the clamping subassembly can comprise a guiding roller 100*a* and a clamping roller 100*b* spaced from the guiding roller relative to the fourth rotational axis 102. Optionally, in these aspects, at least a portion of the guiding roller 100*a* of the clamping subassembly 90 can be positioned above the guide arm 92 of the clamping subassembly, and at least a portion of the clamping roller 100*b* can be positioned below the guide arm 60. In exemplary aspects, the clamping roller 100*b* can be configured to apply a clamping force of up to about 200 pounds. Optionally, in further aspects, the guiding roller 100*a* can have an outer surface 104 that is inwardly tapered moving away from the guide arm 92. In these aspects, it is contemplated that the guiding roller 100*a* can be configured to effect rotation of the drill rod 220 as it is being advanced to make a threaded connection with the drill string 200.

In further exemplary aspects, and as shown in FIGS. 2A-2C, the rod engagement assembly 50 can comprise an actuator 120 that is operatively coupled to the guide arm 92 of the clamping subassembly 90 and configured to effect selective pivotal movement of the guide arm 92 relative to the third rotational axis 98. Optionally, in these aspects, the actuator 120 of the rod engagement assembly 50 can comprise, for example and without limitation, a hydraulic powered cylinder. However, it is contemplated that any conventional actuator (e.g., a pneumatic actuator, a mechanical actuator, an electromechanical actuator, and the like) can be used to effect pivotal movement of the guide arm 92 as disclosed herein. In additional aspects, the carrier arm 60 of the rod engagement assembly 50 can have a longitudinal axis 66, and the guide arm 92 of the clamping subassembly 90 can have a longitudinal axis 95. In these aspects, and as shown in FIGS. 3A-4B and 9A-9E, absent activation of the actuator 42 of the arm assembly 30, the longitudinal axis 95 of the guide arm 92 can have a substantially constant angular orientation relative to the longitudinal axis 66 of the carrier arm 60 as the arm assembly moves about and between the parked position and the deployed position.

In further exemplary aspects, and with reference to FIGS. 2A-2B and 3A-3B, the rod-supporting subassembly 70 can have first and second surfaces 72, 74 that cooperate to define the V-shaped receiving channel 76. In these aspects, the second surface 74 can be positioned at a selected acute angle 78 relative to the first surface 72 within a transverse plane 80 that is perpendicular to the longitudinal axis 212 of the drill mast 210. In order to accommodate a wide range of drill rod diameters, it is contemplated that the selected acute angle 78 can range from about 30 degrees to about 80 degrees or from about 50 degrees to about 70 degrees and, in exemplary aspects, be about 60 degrees. Within the transverse plane 80, the first surface 72 of the rod-supporting subassembly 70 can be substantially parallel to the carrier arm 60 of the rod engagement assembly 50, and the second surface 74 of rod-supporting subassembly 70 can be substantially parallel to the guide arm 92 of the clamping subassembly when the guide arm is in the open position. In additional aspects, within the transverse plane 80, the second surface 74 of the rod-supporting subassembly 70 is spaced from the fourth rotational axis 102 by a separation distance 82 that is measured relative to the longitudinal axis 66 of the carrier arm 60. Absent activation of the actuator 120 of the rod engagement assembly 50, the separation distance 82 can remain substantially constant as the arm assembly 30 moves about and between the parked position and the deployed position. In further aspects, it is contemplated that, with the guide arm 92 positioned in an open position as shown in FIGS. 3A-3B and 9A-9D, the guide arm can be oriented substantially parallel to the opposed second surface 74 of the rod-supporting subassembly.

In exemplary aspects, and with reference to FIGS. 1-4B, it is contemplated that the first and second surfaces 72, 74 of the rod-supporting subassembly 70 can cooperate to define a portion of a triangular enclosure that surrounds a drill rod as further disclosed herein. In exemplary aspects, the first surface 72 and the second surface 74 can have substantially equal widths, and, with reference to FIG. 9E, the guide arm 92 can cooperate with the first and second surfaces to define a substantially equilateral triangle when it is advanced to the closed position.

Optionally, in further exemplary aspects, the rod-supporting subassembly 70 can further comprise a funnel portion 84 that extends upwardly from the first and second surfaces 72, 74 and is configured to guide the drill rod 220 into V-shaped receiving channel 76. In these aspects, and as shown in FIGS. 2A and 8A, the funnel portion 84 can optionally be angled away from the V-shaped receiving channel 76 at a selected acute angle 86 relative to a horizontal axis. In order to accommodate a wide range of drill rod diameters, it is contemplated that the selected acute angle 86 can range from about 45 degrees to about 85 degrees or from about 50 degrees to about 80 degrees and, in exemplary aspects, be about 70 degrees. Similarly, as shown in FIG. 8B, the funnel portion 84 can optionally be angled away from the first and second surfaces 72, 74 at a selected acute angle 87, measured relative to a plane coinciding with the first and second surfaces. It is contemplated that the selected acute angle 87 can range from about 5 degrees to about 45 degrees or from about 10 degrees to about 30 degrees and, more preferably, be about 20 degrees.

In further exemplary aspects, and with reference to FIG. 7, the drill rod alignment device can further comprise a control panel 130. In these aspects, the control panel 30 can be in communication with at least one processor 135. Optionally, the at least one processor 135 can comprise a programmable logic controller (PLC) 138. However, it is further contemplated that the at least one processor 135 can optionally comprise a computer or remote computing device (e.g., smartphone, tablet, PDA, laptop or handheld computer, and the like) having a processor. In use, the at least one processor 135 can be configured to restrict pivotal movement of the at least one arm linkage until the feed frame assembly has been positioned in a selected vertical position, such as, for example, a position above a foot clamp. In additional aspects, the at least one processor 135 can be configured to restrict pivotal movement of the guide arm of the clamping subassembly until the arm assembly is in the deployed position. In further exemplary aspects, the at least one processor 135 can be configured to restrict axial movement of the drill rod alignment device relative to the longitudinal axis of the drill mast until the arm assembly is positioned in the parked position. In these aspects, it is contemplated that the at least one processor 135 can be configured to maintain the axial position of the arm assembly (and the rod engagement assembly) during pivotal movement of the arm assembly to and from the deployed position. Optionally, in exemplary aspects, and with reference to FIG. 10, when the actuators of the drill rod alignment device comprise hydraulic cylinders, it is contemplated that the drill rod alignment device can further comprise a plurality of hydraulic sequencing valves, and the at least one processor 135 can be configured to selectively pressurize hoses that initiate movement of the alignment device to a parked position or to a deployed position as further disclosed herein.

Although the at least one processor 135 can initiate pressurization of the hoses to effect movement of the alignment device to a parked position or to a deployed position, it is understood that the hydraulic sequencing valves can operate independently of the at least one processor 135 (e.g., the PLC 138). For example, operation of the hydraulic sequencing valves and corresponding lift and swing cylinders can be controlled based upon changes in pressure that occur after the initial "park" or "deploy" command is provided by the at least one processor 135. In operation, after receiving a "deploy" command, hydraulic pressure can be sent to the lift cylinder, and when the pressure is high enough (when the lift cylinder hits a hard stop or reaches the end of its stroke) oil can be be allowed to flow to an extend side of the swing cylinder, at which point the swing cylinder is pressurized to effect extension of the device toward the deployed position. In reverse (to move the device to a parked position in response to a "park" command), hydraulic pressure can be sent to retract the swing cylinder. When the pressure is high enough within the swing cylinder (determined based upon a threshold pressure setting for the associated sequence valve), the oil can be allowed to retract the lift cylinder. In operation, it is contemplated that the sequencing valves can be configured to maintain lift pressure within a lift cylinder (e.g., actuator 26) until the drill rod alignment device reaches a closed position as disclosed herein. After the drill rod alignment device reaches the closed position (e.g., following secure engagement of a rod), the lift pressure can be released to permit axial lowering of the engaged drill rod. An exemplary hydraulic sequencing assembly is depicted in FIG. 10, which includes sequence valves 160, a hydraulic cartridge 164, and a manifold 162 as are known in the art. It is contemplated that the hydraulic sequence valves disclosed herein can be configured to ensure completion of the stroke of a corresponding hydraulic cylinder (e.g., lift, or swing). As further disclosed herein, the hydraulic sequencing assembly can be configured to determine oil (or other fluid) delivery sequences based entirely on the current position of the drill rod alignment device (e.g., parked or deployed position), without the need for processor control. Thus, it is contemplated that the disclosed hydraulic sequencing assembly can limit the number of hoses and wires required to implement the movement of the device as disclosed herein, thereby making the device robust and easy to maintain. In exemplary aspects, the hydraulic sequencing assembly does not comprise any electrical wires.

Although disclosed herein as including hydraulic sequencing valves that are generally operated independently of the control panel, in alternative aspects, it is contemplated that the sequencing valves can be eliminated and that the at least one processor 135 (e.g., the PLC 138) can control the operation of the hydraulic cylinders.

In exemplary aspects, the control panel 130 can comprise a user interface comprising a series of user input elements that allow a user to selectively control the operation of a drill rod alignment device as disclosed herein. In one aspect, as shown in FIG. 7, the user interface of the control panel 130 can comprise a user input element 136 (e.g., at least one switch or button) for controlling the opening and closing of chuck 215. In another aspect, the user interface of the control panel 130 can comprise a user input element 137 (e.g., a multi-position switch) to move the drilling system among various operating modes, including, for example and without limitation, a drilling mode, a rod-handling mode, and a mode where drill rods are axially advanced relative to the longitudinal axis 212 of the mast 210 (by sequencing the chuck 215 and the foot clamp). In another aspect, the user interface of the control panel 130 can comprise a user input element 139 (e.g., a multi-position switch) that can be moved about and between at least first and second positions to selectively open and close a foot clamp as further disclosed herein. In another aspect, the user interface of the control panel 130 can comprise a user input element 140 (e.g., a three-position switch) that is moveable among various tripping modes, including, for example and without limitation, an upward tripping mode, a standard downward tripping mode, and a second downward tripping mode that enables control of a drill rod alignment device as disclosed herein. In this aspect, it is contemplated that the drill rod alignment device can only be activated when the user input element 140 is positioned in the position corresponding to the second downward tripping mode. In another aspect, the user interface of the control panel 130 can comprise a user input element 144 (e.g., a multi-position switch) that is moveable among multiple positions to selectively make or break a joint by controlling the opening and closing of the clamping subassembly 90 when the drill rod alignment device is activated as disclosed herein. In exemplary aspects, when the switch 144 is turned clockwise (MAKE), it can actuate fine feed down, clockwise rotation, and the clamping assembly. When the switch 144 is turned counter clockwise, it can actuate fine feed up and counterclockwise rotation. In another aspect, the user interface of the control panel 130 can comprise a user input element 145 (e.g., a multi-position switch) that is moveable among multiple positions to selectively actuate the sequential lifting and swinging of the arm assembly 30 about and between a parked (fully retracted) position and a deployed position as disclosed herein. In further aspects, it is contemplated that the user interface of the control panel 130 can comprise additional user input elements, such as, for example and without limitation, a user input element 141 for controlling clockwise rotation of the device (0 to Max), a user input element 142 (e.g., a joystick type controller) for controlling rod delivery parameters (determined based upon input received from user input element 146 further disclosed herein), a user input element 143 (e.g., a joystick type controller) for controlling drill head movement (including sequenced side shift and tilt, for example with left directional movement tilting the head in a downward direction before shifting left and right directional movement shifting the head right and then tilting the head in an upward direction, as well as fast upward and downward feeding), a user input element 146 (e.g., a multi-position switch) for controlling the function of element 142 (e.g., by identifying the source of a drill rod as a rod shuttle clamp, a mainline hoist, a wireline winch, and the like), and a user input element 147 (e.g, a multi-position switch) for controlling upward and downward head fine feed.

In still further exemplary aspects, as shown in the Figures, the drill rod alignment device can comprise a plurality of pins, bolts, or other fasteners that are configured to effect pivotal coupling of device components. For example, as shown in FIGS. 2A-2B, the arm assembly 30 can optionally comprise a spacer 35 positioned between the outer arm linkages 34*a*; a first pin 44 positioned within aligned holes of the support element 32 and the outer arm linkages 34*a*; a second pin 46 coupled to actuator 42 and positioned within aligned holes of the support element 32 and the inner arm linkages 34*b*; a bushing 47 that receives and surrounds the first pin 44; screws 45 and a trunnion boss 48 for coupling the outer arm linkages 34*a* to the actuator 42; and a spacer assembly with a spacer 49*a* and screw 49*b* for coupling the inner arm linkages 34*b* to the carrier frame 52. Optionally, as shown in FIG. 2A, the rod engagement assembly 50 can further comprise a bushing 65 for surrounding a pin that couples the outer arm linkages 34*a* to the carrier frame 52; an adjustable stop (e.g., screw) 67 for restricting undesired movement of the funnel element 84 (carrier arm 60 can pivot relative to the first end 54 of the coupling frame, and this pivotal motion is limited in one direction by the spring tension and in the other direction by the adjustable stop 67, with the head of the adjustable stop (e.g., screw) 67 contacting the second end 56 of the coupling frame); a screw 68 configured to secure the rod-supporting subassembly 70 to a support frame 69 that extends upwardly from the carrier arm 60; and a support arm 63 that is operatively coupled to the coupling frame and extends under the carrier arm to couple the actuator 120 to the carrier arm.

In exemplary aspects, and as shown in FIG. 10, the drill rod alignment device can optionally comprise a lift stop element 170 that is selectively and adjustably secured to the feed frame assembly at a desired axial position. In use, the lift stop element 170 can prevent further advancement of the drill rod alignment device relative to the feed frame assembly, thereby increasing hydraulic pressure and ultimately leading to swinging of the device at the desired axial position (as opposed to the axial location corresponding to the completed stroke of the lift cylinder).

Figure 5:
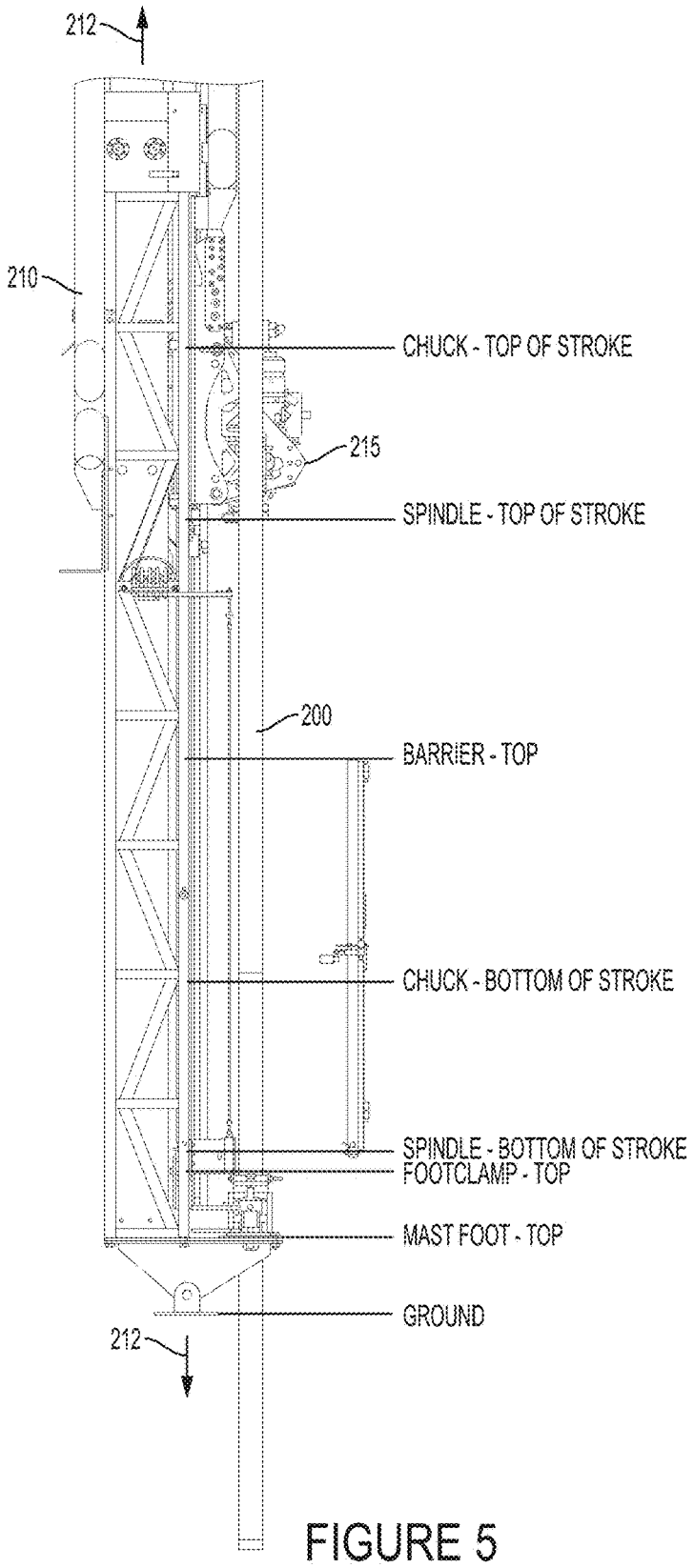
FIG. 5 depicts an exemplary drill mast, drill string, and chuck for use with a drill rod alignment device as disclosed herein. More particularly.

A drill rod alignment device as disclosed herein can be provided as part of a drilling system having a drill mast 210 and a drill head with a chuck 215. In exemplary aspects, and as depicted in FIGS. 5-6, it is contemplated that the drill rod alignment device can be coupled, welded, or otherwise secured to the drill mast 210 using conventional mechanical attachment mechanisms as further disclosed herein. It is contemplated that the drill rod alignment device can be provided as part of a coring drill rig or a percussive drill rig, in either surface or underground applications. In exemplary aspects, the drilling system can further comprise a drill rod handling device as is known in the art. An exemplary drill rod handling device is described in U.S. patent application Ser. No. 14/584,877, filed Dec. 29, 2014 and entitled "Drill Rod Handling System for Moving Drill Rods to and from an Operative Position," which is incorporated by reference herein in its entirety.

In use, the drill rod alignment device can align a drill rod with a drill string in a hand-free manner. It is contemplated that the selective vertical movement of the drill rod alignment device and the selective pivotal movement of the arm assembly and the rod engagement assembly provide compatibility with drill rods of any size (e.g., drill rods ranging from size BQ through PHD) without the need for changing rod guides while also permitting full movement of the drill head. Additionally, because the drill rod alignment device is secured to the drill mast, the drill rod alignment device tilts with the drill mast to permit use on angled holes.

Figure 9A:
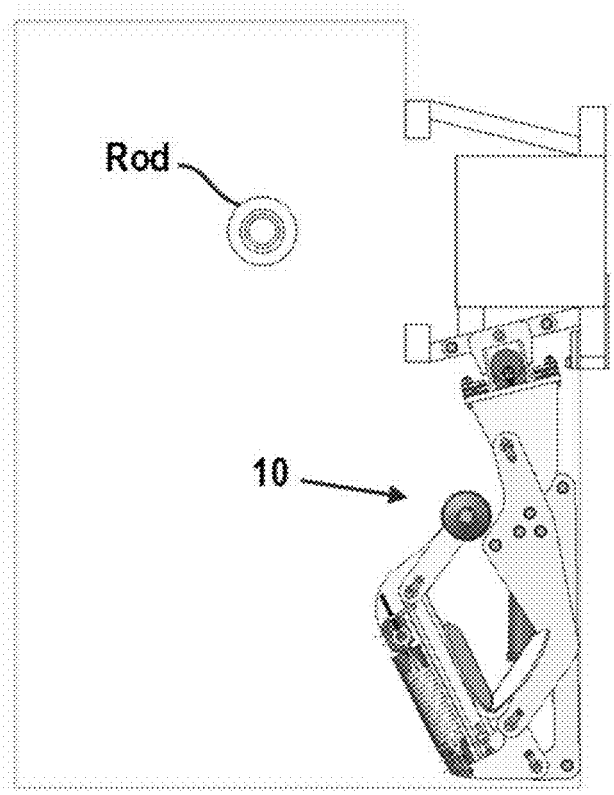
Figure 9B:
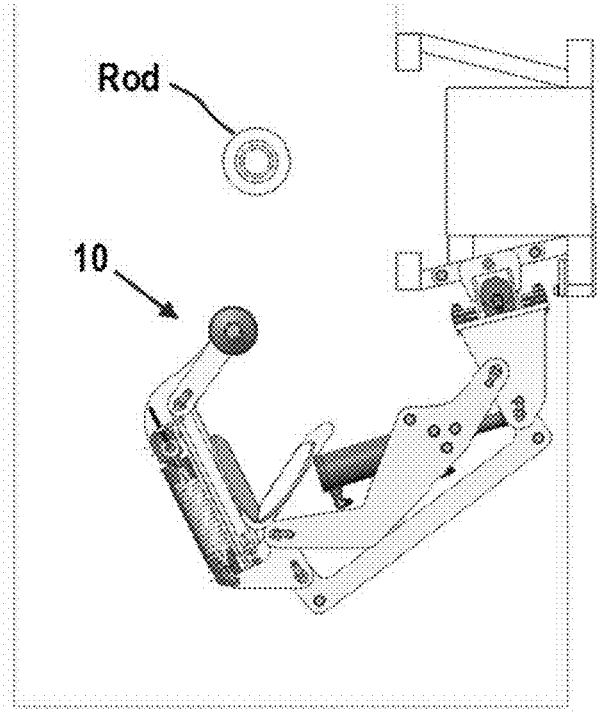
Figure 9C:
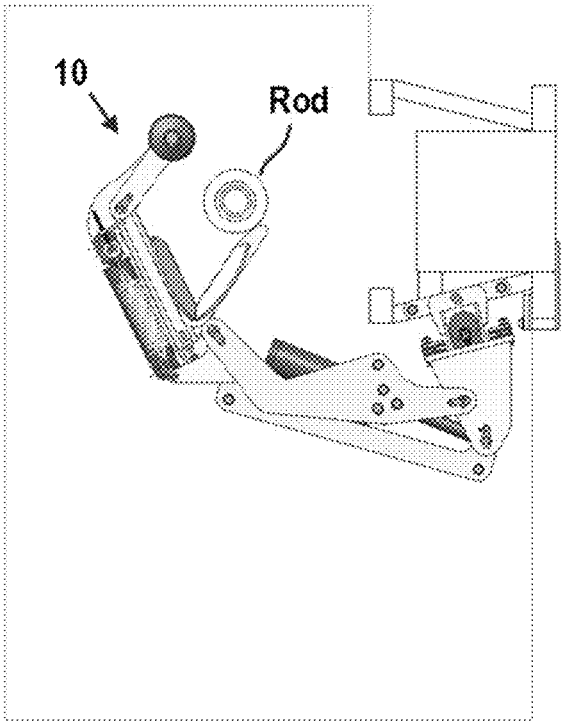
Figure 9D:
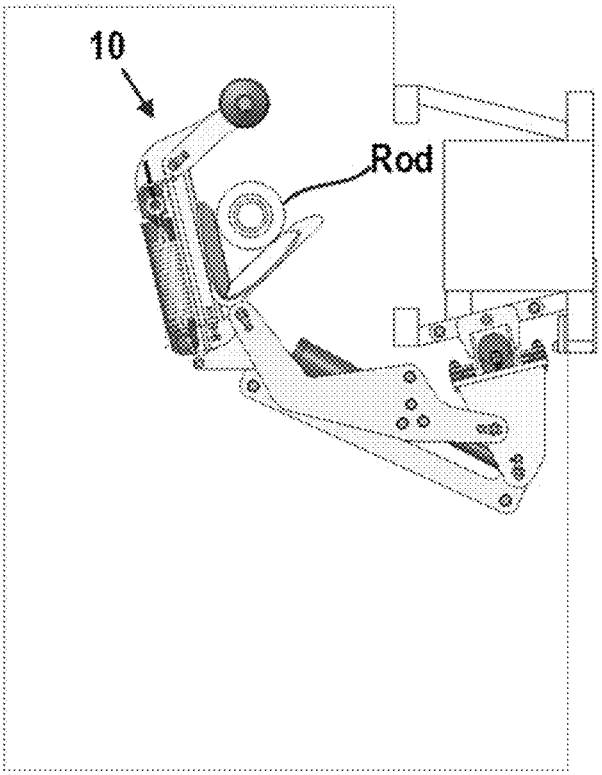
Figure 9E:
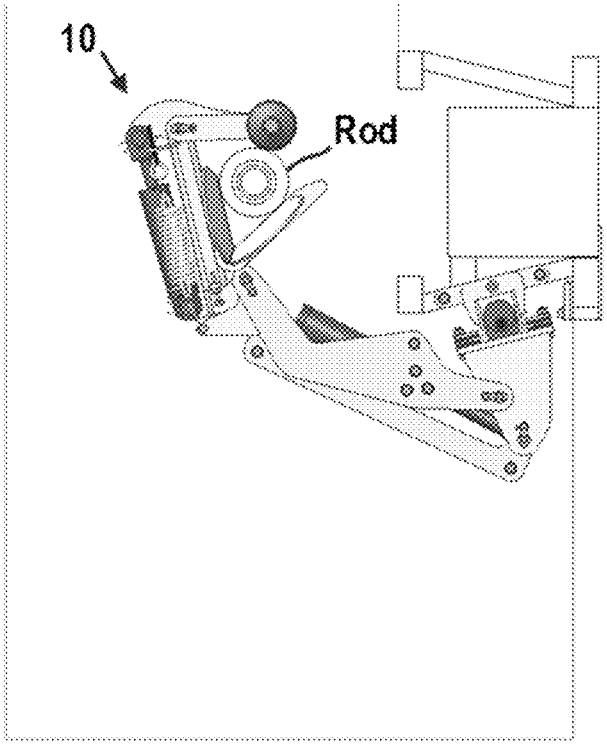

In operation, and with reference to FIGS. 9A-9E, contact between the drill rod 220 and at least one of the first and second surfaces 72, 74 of the rod-supporting subassembly is configured to allow for and effect pivotal movement of the coupling frame 52 of the rod engagement assembly 50 relative to the arm assembly 30. For example, contact between the drill rod 220 and the second surface 74 of the rod-supporting subassembly 70 can effect pivotal movement of the coupling frame 52 toward the drill rod 220. More particularly, as shown in FIG. 9A, the arm assembly 30 of the drill rod alignment device 10 can initially be positioned in a parked (fully retracted) position, with the clamping subassembly in an open position. As shown in FIG. 9B, actuator 42 can be activated to effect swinging movement of the arm assembly 30 toward a deployed position, with the clamping subassembly remaining in an open position. As shown in FIG. 9C, swinging movement of the arm assembly 30 can continue until the second surface 74 of the rod-supporting subassembly contacts the portion of the drill rod closest to the mast, thereby causing rotation of the rod engagement assembly 50 relative to the third pivot point 150*c*. As shown in FIG. 9D, the rod engagement assembly 50 can continue rotating until the first surface 72 of the rod-supporting subassembly contacts the drill rod such that both the first surface 72 and second surface 74 of the rod-supporting subassembly are engaging the drill rod. In this position, it is contemplated that the spring 110 can be slightly extended from its initial position. As shown in FIG. 9E, actuator 120 can be activated to effect rotation of the guide arm 92 toward the drill rod (toward its closed position) such that the clamping roller funnels and secures the rod within the receiving channel 76. From this deployed, closed position, it is contemplated that the rod can be safely lowered and rotated to make a joint with a drill string in the manner known in the art and further disclosed herein. It is further contemplated that the disclosed drill rod alignment device can be used with drill rods of all sizes without the need for changing parts or making setting adjustments.

Exemplary Aspects

In view of the described drill rod alignment devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill rod alignment device for aligning a drill rod with a drill string supported by a drill mast, the drill mast having a longitudinal axis, the drill rod alignment device comprising: a feed frame assembly configured for operative coupling to the drill mast, wherein the feed frame assembly is configured for selective axial movement relative to the longitudinal axis of the drill mast; an arm assembly having at least one arm linkage that is pivotally coupled to the feed frame assembly to permit pivotal movement of the arm assembly about and between a parked position and a deployed position; a rod engagement assembly having: a carrier arm having a first end and a second end, wherein the first end of the carrier arm is pivotally coupled to the at least one arm linkage of the arm assembly; a rod-supporting subassembly secured to the carrier arm, wherein the rod-supporting subassembly defines a receiving channel; and a clamping subassembly having a guide arm and at least one roller, wherein the guide arm is pivotally coupled to the second end of the carrier arm, wherein the at least one roller is coupled to the guide arm, wherein, with the arm assembly in the deployed position, the rod-supporting subassembly is configured to contact a drill rod and effect pivotal movement of the carrier arm relative to the at least one arm linkage of the arm assembly, and wherein the guide arm is configured for pivotal movement relative to the carrier arm from an open position to a closed position in which the at least one roller secures the drill rod within the receiving channel.

Aspect 2: The drill rod alignment device of aspect 1, wherein the arm assembly further comprises a support element secured to the feed frame assembly, wherein the at least one arm linkage has a proximal end and a distal end, wherein the proximal end of the at least one arm linkage is pivotally coupled to the support element, wherein the at least one arm linkage is configured for selective pivotal movement relative to a first rotational axis that is substantially parallel to the longitudinal axis of the drill mast, and wherein pivotal movement of the at least one arm linkage relative to the support element is configured to effect movement of the arm assembly about and between the parked position and the deployed position.

Aspect 3: The drill rod alignment device of any one of the preceding aspects, wherein the rod engagement assembly further comprises a coupling frame having a first end and an opposed second end, the first end of the coupling frame being pivotally coupled to the distal end of the at least one arm linkage, wherein the coupling frame is configured for selective pivotal movement relative to a second rotational axis that is substantially parallel to the first rotational axis, and wherein the first end of the carrier arm being pivotally coupled to the first end of the coupling frame.

Aspect 4: The drill rod alignment device of any one of the preceding aspects, wherein the guide arm of the clamping subassembly has a first end and an opposed second end, wherein the first end of the guide arm is pivotally coupled to the second end of the carrier arm, wherein the guide arm is configured for selective pivotal movement relative to a third rotational axis that is substantially parallel to the first rotational axis, and wherein the at least one roller is configured for rotational movement relative to a fourth rotational axis that is substantially parallel to the first rotational axis.

Aspect 5: The drill rod alignment device of any one of the preceding aspects, wherein the rod engagement assembly further comprises a spring coupled to and extending between the second end of the coupling frame and the second end of the carrier arm.

Aspect 6: The drill rod alignment device of any one of the preceding aspects, wherein the feed frame assembly comprises: a feed frame secured to the drill mast; a carrier plate configured for axial movement relative to the feed frame; and an actuator that is operatively coupled to the carrier plate and configured to effect selective axial movement of the carrier plate relative to the longitudinal axis of the drill mast, wherein the support element of the arm assembly is secured to the carrier plate of the feed frame assembly.

Aspect 7: The drill rod alignment device of any one of the preceding aspects, wherein the actuator of the feed frame assembly comprises a hydraulic cylinder.

Aspect 8: The drill rod alignment device of any one of the preceding aspects, wherein the at least one arm linkage comprises a pair of outer arm linkages and at least one inner arm linkage, wherein the outer arm linkages are spaced apart relative to the longitudinal axis of the drill mast, and wherein the at least one inner arm linkage is positioned between the outer arm linkages relative to the longitudinal axis of the drill mast.

Aspect 9: The drill rod alignment device of any one of the preceding aspects, wherein the arm assembly comprises an actuator that is operatively coupled to the at least one inner arm linkage and configured to effect pivotal movement of the at least one inner arm linkage relative to the support element.

Aspect 10: The drill rod alignment device of any one of the preceding aspects, wherein the actuator of the arm assembly is secured to the pair of outer arm linkages.

Aspect 11: The drill rod alignment device of any one of the preceding aspects, wherein the at least one inner arm linkage comprises a pair of inner arm linkages that are spaced apart relative to the longitudinal axis of the drill mast.

Aspect 12: The drill rod alignment device of any one of the preceding aspects, wherein the pair of outer arm linkages are pivotally coupled to the support element at a first pivot point, wherein the at least one inner arm linkage is pivotally coupled to the support element at a second pivot point, and wherein the second pivot point is positioned radially outwardly of the first location relative to the longitudinal axis of the drill mast.

Aspect 13: The drill rod alignment device of any one of the preceding aspects, wherein the first end of the coupling frame is pivotally coupled to the pair of outer arm linkages at a third pivot point, wherein the first end of the coupling frame is pivotally coupled to the at least one inner arm linkage at a fourth pivot point, and wherein the fourth pivot point is spaced from the third pivot point.

Aspect 14: The drill rod alignment device of any one of the preceding aspects, wherein the coupling frame is substantially L-shaped.

Aspect 15: The drill rod alignment device of any one of the preceding aspects, wherein the carrier arm of the rod-supporting subassembly has a longitudinal axis, and wherein the longitudinal axis of the carrier arm is substantially parallel to the spring.

Aspect 16: The drill rod alignment device of any one of the preceding aspects, wherein the at least one roller of the clamping subassembly comprises a guiding roller and a clamping roller spaced from the guiding roller relative to the fourth rotational axis.

Aspect 17: The drill rod alignment device of any one of the preceding aspects, wherein the guiding roller of the clamping subassembly is positioned above the guide arm of the clamping subassembly, and wherein the clamping roller is positioned below the guide arm.

Aspect 18: The drill rod alignment device of any one of the preceding aspects, wherein the guiding roller has an outer surface that is inwardly tapered moving away from the guide arm.

Aspect 19: The drill rod alignment device of any one of the preceding aspects, wherein the rod engagement assembly comprises an actuator that is operatively coupled to the guide arm of the clamping subassembly and configured to effect selective pivotal movement of the guide arm relative to the third rotational axis.

Aspect 20: The drill rod alignment device of any one of the preceding aspects, wherein the actuator of the rod engagement assembly comprises a hydraulic cylinder.

Aspect 21: The drill rod alignment device of any one of the preceding aspects, wherein the carrier arm of the rod-supporting subassembly has a longitudinal axis, and wherein the guide arm of the clamping subassembly has a longitudinal axis, and wherein absent activation of the actuator of the arm assembly, the longitudinal axis of the guide arm has a substantially constant angular orientation relative to the longitudinal axis of the carrier arm as the arm assembly moves about and between the parked position and the deployed position.

Aspect 22: The drill rod alignment device of any one of the preceding aspects, wherein the rod-supporting subassembly has first and second surfaces that cooperate to define the receiving channel, wherein the second surface is positioned at a selected acute angle relative to the first surface within a transverse plane that is perpendicular to the longitudinal axis of the drill mast.

Aspect 23: The drill rod alignment device of any one of the preceding aspects, wherein the receiving channel is a substantially V-shaped receiving channel.

Aspect 24: The drill rod alignment device of any one of the preceding aspects, wherein within the transverse plane, the first surface of the rod-supporting subassembly is substantially parallel to the carrier arm of the rod engagement assembly and the second surface of the rod-supporting subassembly is substantially parallel to the guide arm of the clamping subassembly when the guide arm is in the open position.

Aspect 25: The drill rod alignment device of any one of the preceding aspects, wherein within the transverse plane, the second surface of the rod-supporting subassembly is spaced from the fourth rotational axis by a separation distance, and wherein absent activation of the actuator of the rod engagement assembly, the separation distance remains substantially constant as the arm assembly moves about and between the parked position and the deployed position.

Aspect 26: The drill rod alignment device of any one of the preceding aspects, wherein the rod-supporting subassembly further comprises a funnel portion that extends upwardly from the first and second surfaces and is configured to guide the drill rod into the receiving channel.

Aspect 27: The drill rod alignment device of any one of the preceding aspects, wherein the funnel portion is angled away from the receiving channel at a selected acute angle.

Aspect 28: The drill rod alignment device of any one of the preceding aspects, wherein the funnel portion and the receiving channel are configured to cooperate to accommodate drill rods of varying sizes.

Aspect 29: The drill rod alignment device of any one of the preceding aspects, wherein contact between the drill rod and at least one of the first and second surfaces of the rod-supporting subassembly is configured to effect pivotal movement of the coupling frame of the rod engagement assembly relative to the arm assembly.

Aspect 30: The drill rod alignment device of any one of the preceding aspects, further comprising a hydraulic sequencing assembly, and wherein the hydraulic sequencing assembly is configured to restrict pivotal movement of the at least one arm linkage until the feed frame assembly has been positioned in a selected vertical position.

Aspect 31: The drill rod alignment device of aspect 30, wherein the hydraulic sequencing assembly is configured to restrict pivotal movement of the guide arm of the clamping subassembly until the arm assembly is in the deployed position.

Aspect 32: The drill rod alignment device of aspect 30, wherein the hydraulic sequencing assembly does not comprise electrical wiring.

Aspect 33: The drill rod alignment device of any one of the preceding aspects, wherein the inner and outer linkages cooperate to form a four-bar linkage.

Aspect 34: A drilling system comprising: a drill mast; a drill head; and the drill rod alignment device of any one of the preceding aspects.

Aspect 35: The drilling system of aspect 34, further comprising a control panel and at least one processor in operative communication with the processor, wherein the at least one processor is configured to control operation of the drilling system.

Aspect 36: A method of aligning a drill rod with a drill string using the drill rod alignment device of any one of aspects 1-33.

Aspect 37: The method of aspect 36, wherein a first drill rod is aligned with a first drill string using the drill rod alignment device, wherein a second drill rod is aligned with a second drill string using the drill rod alignment device without replacing, removing, or adjusting the rod-supporting subassembly, wherein the first and second drill rods have respective diameters, and wherein the diameter of the first drill rod is greater than the diameter of the second drill rod.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A drill rod alignment device for aligning a drill rod with a drill string supported by a drill mast, the drill mast having a longitudinal axis, the drill rod alignment device comprising:

a feed frame assembly configured for operative coupling to the drill mast, wherein the feed frame assembly is configured for selective axial movement relative to the longitudinal axis of the drill mast;

an arm assembly having at least one arm linkage that is pivotally coupled to the feed frame assembly to permit pivotal movement of the arm assembly about and between a parked position and a deployed position;

a rod engagement assembly having:

a carrier arm having a first end and a second end, wherein the first end of the carrier arm is pivotally coupled to the at least one arm linkage of the arm assembly;

a rod-supporting subassembly secured to the carrier arm, wherein the rod-supporting subassembly defines a receiving channel;

a clamping subassembly having a guide arm and at least one roller, wherein the guide arm is pivotally coupled to the second end of the carrier arm, wherein the at least one roller is coupled to the guide arm;

a coupling frame having a first end and an opposed second end, the first end of the coupling frame being pivotally coupled to the distal end of the at least one arm linkage, wherein the first end of the carrier arm is pivotally coupled to the first end of the coupling frame, and wherein the coupling frame is configured for selective pivotal movement relative to a first rotational axis that is substantially parallel to the longitudinal axis of the drill mast; and a spring coupled to and extending between the second end of the coupling frame and the second end of the carrier arm, wherein, with the arm assembly in the deployed position, the rod-supporting subassembly is configured to contact a drill rod and effect pivotal movement of the carrier arm relative to the at least one arm linkage of the arm assembly, and wherein the guide arm is configured for pivotal movement relative to the carrier arm from an open position to a closed position in which the at least one roller secures the drill rod within the receiving channel.

2. The drill rod alignment device of claim 1, wherein the arm assembly further comprises a support element secured to the feed frame assembly, wherein the at least one arm linkage has a proximal end and a distal end, wherein the proximal end of the at least one arm linkage is pivotally coupled to the support element, wherein the at least one arm linkage is configured for selective pivotal movement relative to a second rotational axis that is substantially parallel to the first rotational axis, and wherein pivotal movement of the at least one arm linkage relative to the support element is configured to effect movement of the arm assembly about and between the parked position and the deployed position.

3. The drill rod alignment device of claim 2, wherein the guide arm of the clamping subassembly has a first end and an opposed second end, wherein the first end of the guide arm is pivotally coupled to the second end of the carrier arm, wherein the guide arm is configured for selective pivotal movement relative to a third rotational axis that is substantially parallel to the first rotational axis, and wherein the at least one roller is configured for rotational movement relative to a fourth rotational axis that is substantially parallel to the first rotational axis.

4. The drill rod alignment device of claim 3, wherein the feed frame assembly comprises:

a feed frame secured to the drill mast;

a carrier plate configured for axial movement relative to the feed frame; and an actuator that is operatively coupled to the carrier plate and configured to effect selective axial movement of the carrier plate relative to the longitudinal axis of the drill mast, wherein the support element of the arm assembly is secured to the carrier plate of the feed frame assembly.

5. The drill rod alignment device of claim 4, wherein the actuator of the feed frame assembly comprises a hydraulic cylinder.

6. The drill rod alignment device of claim 3, wherein the at least one arm linkage comprises a pair of outer arm linkages and at least one inner arm linkage, wherein the outer arm linkages are spaced apart relative to the longitudinal axis of the drill mast, and wherein the at least one inner arm linkage is positioned between the outer arm linkages relative to the longitudinal axis of the drill mast, and wherein the arm assembly comprises an actuator that is operatively coupled to the at least one inner arm linkage and configured to effect pivotal movement of the at least one inner arm linkage relative to the support element.

7. The drill rod alignment device of claim 6, wherein the actuator of the arm assembly is secured to the pair of outer arm linkages.

8. The drill rod alignment device of claim 3, wherein the at least one roller of the clamping subassembly comprises a guiding roller and a clamping roller spaced from the guiding roller relative to the fourth rotational axis.

9. The drill rod alignment device of claim 8, wherein the guiding roller of the clamping subassembly is positioned above the guide arm of the clamping subassembly, and wherein the clamping roller is positioned below the guide arm.

10. The drill rod alignment device of claim 9, wherein the guiding roller has an outer surface that is inwardly tapered moving away from the guide arm.

11. The drill rod alignment device of claim 3, wherein the rod engagement assembly comprises an actuator that is operatively coupled to the guide arm of the clamping subassembly and configured to effect selective pivotal movement of the guide arm relative to the third rotational axis.

12. The drill rod alignment device of claim 11, wherein the actuator of the rod engagement assembly comprises a hydraulic cylinder.

13. The drill rod alignment device of claim 11, wherein the carrier arm of the rod-supporting subassembly has a longitudinal axis, and wherein the guide arm of the clamping subassembly has a longitudinal axis, and wherein absent activation of the actuator of the arm assembly, the longitudinal axis of the guide arm has a substantially constant angular orientation relative to the longitudinal axis of the carrier arm as the arm assembly moves about and between the parked position and the deployed position.

14. The drill rod alignment device of claim 3, wherein the rod-supporting subassembly has first and second surfaces that cooperate to define the receiving channel, wherein the second surface is positioned at a selected acute angle relative to the first surface within a transverse plane that is perpendicular to the longitudinal axis of the drill mast, wherein within the transverse plane, the first surface of the rod-supporting subassembly is substantially parallel to the carrier arm of the rod engagement assembly and the second surface of the rod-supporting subassembly is substantially parallel to the guide arm of the clamping subassembly when the guide arm is in the open position.

15. The drill rod alignment device of claim 14, wherein within the transverse plane, the second surface of the rod-supporting subassembly is spaced from the fourth rotational axis by a separation distance, and wherein absent activation of the actuator of the rod engagement assembly, the separation distance remains substantially constant as the arm assembly moves about and between the parked position and the deployed position.

16. The drill rod alignment device of claim 1, wherein the at least one arm linkage comprises a pair of outer arm linkages and at least one inner arm linkage, wherein the outer arm linkages are spaced apart relative to the longitudinal axis of the drill mast, and wherein the at least one inner arm linkage is positioned between the outer arm linkages relative to the longitudinal axis of the drill mast.

17. The drill rod alignment device of claim 16, wherein the at least one inner arm linkage comprises a pair of inner arm linkages that are spaced apart relative to the longitudinal axis of the drill mast.

18. The drill rod alignment device of claim 16, wherein the pair of outer arm linkages are pivotally coupled to the support element at a first pivot point, wherein the at least one inner arm linkage is pivotally coupled to the support element at a second pivot point, and wherein the second pivot point is positioned radially outwardly of the first location relative to the longitudinal axis of the drill mast.

19. The drill rod alignment device of claim 18, wherein the first end of the coupling frame is pivotally coupled to the pair of outer arm linkages at a third pivot point, wherein the first end of the coupling frame is pivotally coupled to the at least one inner arm linkage at a fourth pivot point, and wherein the fourth pivot point is spaced from the third pivot point.

20. The drill rod alignment device of claim 19, wherein the coupling frame is L-shaped.

21. The drill rod alignment device of claim 19, wherein the inner and outer linkages cooperate to form a four-bar linkage.

22. The drill rod alignment device of claim 1, wherein the carrier arm of the rod-supporting subassembly has a longitudinal axis, and wherein the longitudinal axis of the carrier arm is substantially parallel to the spring.

23. The drill rod alignment device of claim 1, wherein the rod-supporting subassembly has first and second surfaces that cooperate to define the receiving channel, wherein the second surface is positioned at a selected acute angle relative to the first surface within a transverse plane that is perpendicular to the longitudinal axis of the drill mast.

24. The drill rod alignment device of claim 23, wherein the receiving channel is a V-shaped receiving channel.

25. The drill rod alignment device of claim 23, wherein the rod-supporting subassembly further comprises a funnel portion that extends upwardly from the first and second surfaces and is configured to guide the drill rod into the receiving channel.

26. The drill rod alignment device of claim 25, wherein the funnel portion is angled away from the receiving channel at a selected acute angle.

27. The drill rod alignment device of claim 23, wherein contact between the drill rod and at least one of the first and second surfaces of the rod-supporting subassembly is configured to effect pivotal movement of the coupling frame of the rod engagement assembly relative to the arm assembly.

28. The drill rod alignment device of claim 1, further comprising a hydraulic sequencing assembly, and wherein the hydraulic sequencing assembly is configured to restrict pivotal movement of the at least one arm linkage until the feed frame assembly has been positioned in a selected vertical position.

29. The drill rod alignment device of claim 28, wherein the hydraulic sequencing assembly is configured to restrict pivotal movement of the guide arm of the clamping subassembly until the arm assembly is in the deployed position.

30. The drill rod alignment device of claim 29, wherein the hydraulic sequencing assembly does not comprise electrical wiring.

31. A drill rod alignment device for aligning a drill rod with a drill string supported by a drill mast, the drill mast having a longitudinal axis, the drill rod alignment device comprising:

a feed frame assembly configured for operative coupling to the drill mast, wherein the feed frame assembly is configured for selective axial movement relative to the longitudinal axis of the drill mast;

an arm assembly having at least one arm linkage that is pivotally coupled to the feed frame assembly to permit pivotal movement of the arm assembly about and between a parked position and a deployed position, wherein the arm assembly further comprises a support element secured to the feed frame assembly, wherein the at least one arm linkage has a proximal end and a distal end, wherein the proximal end of the at least one arm linkage is pivotally coupled to the support element, wherein the at least one arm linkage is configured for selective pivotal movement relative to a first rotational axis that is substantially parallel to the longitudinal axis of the drill mast, wherein pivotal movement of the at least one arm linkage relative to the support element is configured to effect movement of the arm assembly about and between the parked position and the deployed position;

a rod engagement assembly having:

a carrier arm having a first end and a second end, wherein the first end of the carrier arm is pivotally coupled to the at least one arm linkage of the arm assembly;

a rod-supporting subassembly secured to the carrier arm, wherein the rod-supporting subassembly defines a receiving channel;

a clamping subassembly having a guide arm and at least one roller, wherein the guide arm is pivotally coupled to the second end of the carrier arm, wherein the guide arm of the clamping subassembly has a first end and an opposed second end, wherein the at least one roller is coupled to the guide arm, and wherein the first end of the guide arm is pivotally coupled to the second end of the carrier arm;

a coupling frame having a first end and an opposed second end, the first end of the coupling frame being pivotally coupled to the distal end of the at least one arm linkage, wherein the first end of the carrier arm is pivotally coupled to the first end of the coupling frame, and wherein the coupling frame is configured for selective pivotal movement relative to a second rotational axis that is substantially parallel to the first rotational axis; and a spring coupled to and extending between the second end of the coupling frame and the second end of the carrier arm, wherein, with the arm assembly in the deployed position, the rod-supporting subassembly is configured to contact a drill rod and effect pivotal movement of the carrier arm relative to the at least one arm linkage of the arm assembly, wherein the guide arm is configured for pivotal movement relative to the carrier arm from an open position to a closed position in which the at least one roller secures the drill rod within the receiving channel, wherein the guide arm is configured for selective pivotal movement relative to a third rotational axis that is substantially parallel to the first rotational axis, and wherein the at least one roller is configured for rotational movement relative to a fourth rotational axis that is substantially parallel to the first rotational axis.

* * * * *